US008979367B2

(12) United States Patent
Tan

(10) Patent No.: US 8,979,367 B2
(45) Date of Patent: Mar. 17, 2015

(54) SELF OPENING BAGS WITH ATTACHING FEATURES

(71) Applicant: Daniel Brian Tan, Harahan, LA (US)

(72) Inventor: Daniel Brian Tan, Harahan, LA (US)

( * ) Notice: Subject to any disclaimer, the term of this patent is extended or adjusted under 35 U.S.C. 154(b) by 0 days.

(21) Appl. No.: 13/771,759

(22) Filed: Feb. 20, 2013

(65) Prior Publication Data

US 2014/0233866 A1 Aug. 21, 2014

Related U.S. Application Data

(63) Continuation of application No. PCT/US2011/067515, filed on Dec. 28, 2011.

(51) Int. Cl.
*B65D 33/00* (2006.01)

(52) U.S. Cl.
CPC ..... *B65D 33/007* (2013.01); *B65D 33/001* (2013.01); *B65D 33/002* (2013.01)
USPC ..... 383/37; 383/8; 383/9; 206/554

(58) Field of Classification Search
CPC .. B65D 33/001; B65D 33/002; B65D 33/065; B65D 33/14
USPC ..... 383/8, 9, 37; 206/554
See application file for complete search history.

(56) References Cited

U.S. PATENT DOCUMENTS 3,349,991 A * 10/1967 Kessler ..... 383/120
3,411,698 A * 11/1968 Reynolds ..... 383/35
3,979,050 A 9/1976 Cilia
4,078,717 A 3/1978 Stearley
4,759,639 A * 7/1988 DeMatteis ..... 383/7
4,759,742 A * 7/1988 Achelpohl ..... 493/195
4,769,126 A * 9/1988 Roen et al. ..... 206/554
4,785,938 A * 11/1988 Benoit et al. ..... 206/554
4,849,090 A 7/1989 Case et al.
4,854,451 A * 8/1989 Jensen ..... 206/554
4,904,092 A 2/1990 Campbell et al.
4,911,560 A * 3/1990 Hoover et al. ..... 383/8
5,335,788 A * 8/1994 Beasley et al. ..... 206/554
5,346,310 A * 9/1994 Nguyen ..... 383/9
5,395,298 A 3/1995 Moesmann
5,433,363 A * 7/1995 Simhaee ..... 225/47
5,467,572 A * 11/1995 Wile et al. ..... 53/384.1
5,469,970 A * 11/1995 Li ..... 206/554
5,497,884 A 3/1996 DeMatteis et al.
5,562,580 A * 10/1996 Beasley et al. ..... 493/194
5,590,784 A * 1/1997 Daniels ..... 206/554
5,662,225 A * 9/1997 DeMatteis ..... 206/554
5,669,504 A * 9/1997 Leone et al. ..... 206/554

(Continued)

*Primary Examiner* — Jes F Pascua
*Assistant Examiner* — Peter Helvey
(74) *Attorney, Agent, or Firm* — David A. Belasco; Belasco Jacobs & Townsley, LLP

(57) ABSTRACT

A self opening bag includes front and real walls joined at their respective first and second side and bottom edges. The bag is folded at least once parallel to its side edges. At least one attaching feature is located on the outer surface of the bag adjacent the upper end and between the folded walls. The bag is releasably attached to a subsequent bag. The at least one attaching feature causes the bag to open as the bag is pulled from the subsequent bag. The once folded bag may be sealed at the bottom edges after folding to form a star-sealed bag bottom. The bags may be removably attached to each other at a perforation line and wound onto a compact roll for use with a bag dispenser. The bags may have an upper seam, a U-shaped cut and a pair of bag handles. The bags may be corona treated.

7 Claims, 18 Drawing Sheets

(56) References Cited

U.S. PATENT DOCUMENTS

| | | | | | |
|---|---|---|---|---|---|
| 5,690,228 | A | * | 11/1997 | DeMatteis | 206/554 |
| 5,695,064 | A | * | 12/1997 | Huang et al. | 206/554 |
| 5,706,961 | A | * | 1/1998 | Morano | 215/11.3 |
| 5,752,666 | A | * | 5/1998 | Simhaee | 242/160.4 |
| 5,845,779 | A | * | 12/1998 | Wilfong et al. | 206/554 |
| 5,881,882 | A | * | 3/1999 | Fletcher et al. | 206/554 |
| 5,921,390 | A | * | 7/1999 | Simhaee | 206/390 |
| 5,941,393 | A | | 8/1999 | Wilfong, Jr. | |
| 6,059,707 | A | * | 5/2000 | Belias et al. | 493/198 |
| 6,135,281 | A | * | 10/2000 | Simhaee | 206/390 |
| 6,146,017 | A | | 11/2000 | Hodges | |
| 6,159,136 | A | | 12/2000 | Belias et al. | |
| 6,446,811 | B1 | | 9/2002 | Wilfong, Jr. | |
| 6,488,222 | B1 | | 12/2002 | West et al. | |
| 6,945,695 | B2 | * | 9/2005 | Rabiea | 383/37 |
| 6,948,294 | B2 | * | 9/2005 | Rabiea | 53/459 |
| 7,104,942 | B2 | | 9/2006 | Tan | |
| 7,223,016 | B2 | | 5/2007 | Bell | |
| 7,424,963 | B2 | * | 9/2008 | Daniels | 225/93 |
| 7,624,881 | B2 | * | 12/2009 | Wilfong | 211/59.2 |
| 8,408,792 | B2 | * | 4/2013 | Cole et al. | 383/203 |
| 2004/0066988 | A1 | | 4/2004 | Yi Li | |
| 2005/0098600 | A1 | * | 5/2005 | Yeh et al. | 225/93 |
| 2005/0259893 | A1 | * | 11/2005 | Chen | 383/37 |
| 2006/0188180 | A1 | * | 8/2006 | Otsubo | 383/35 |
| 2010/0027917 | A1 | | 2/2010 | McCann | |
| 2011/0075951 | A1 | | 3/2011 | Tseng | |
| 2011/0206302 | A1 | * | 8/2011 | Tan | 383/120 |

* cited by examiner

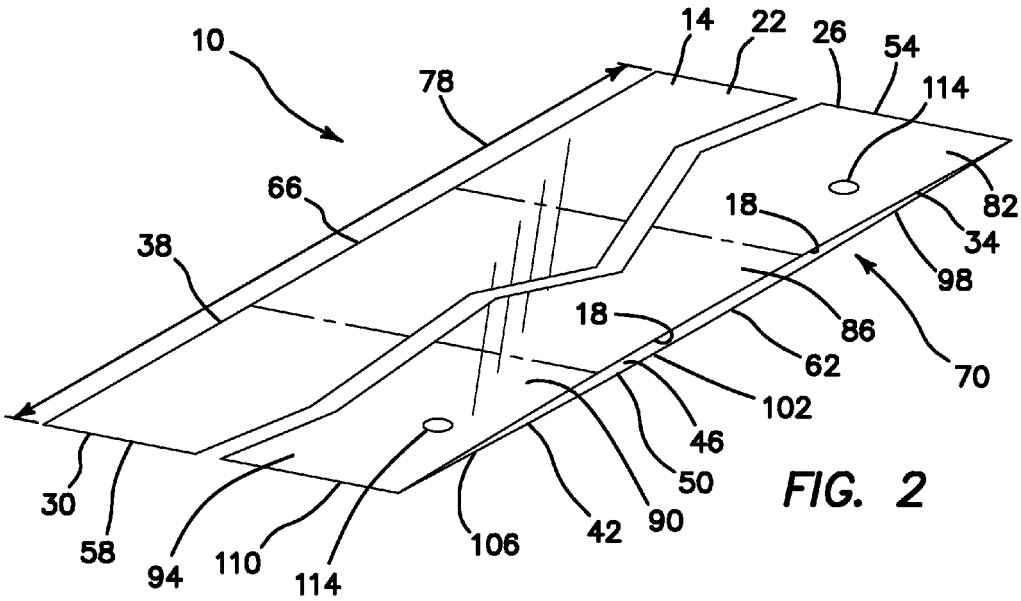
FIG. 2
FIG. 2A
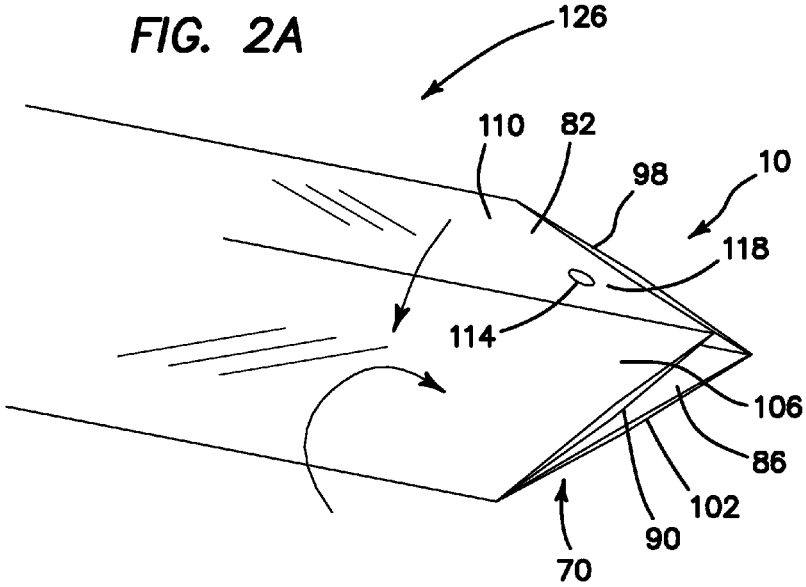

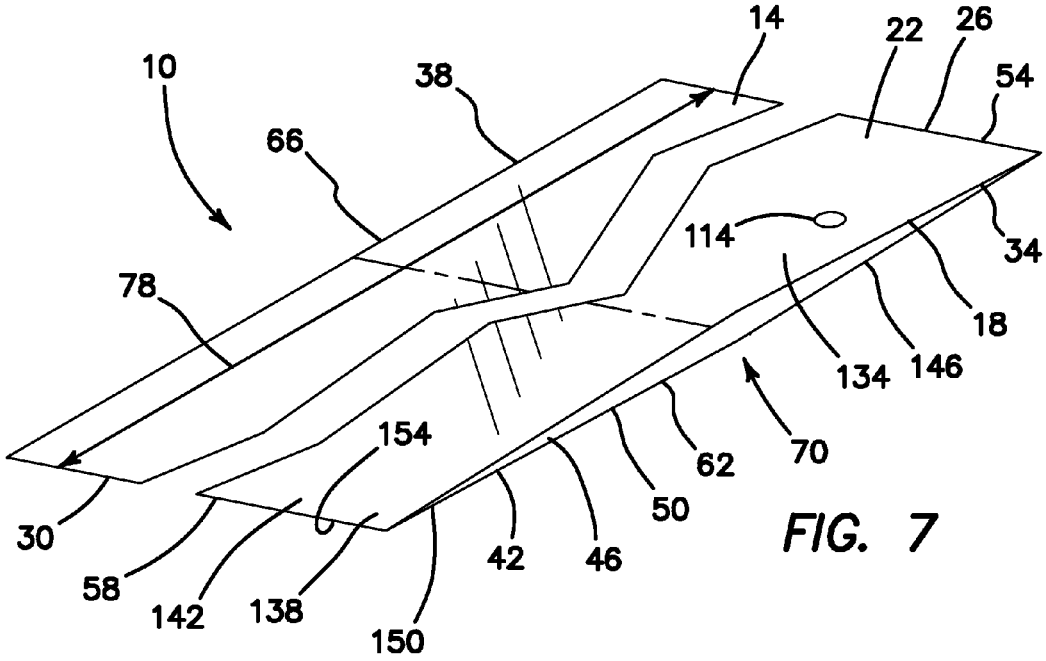
FIG. 7
FIG. 7A
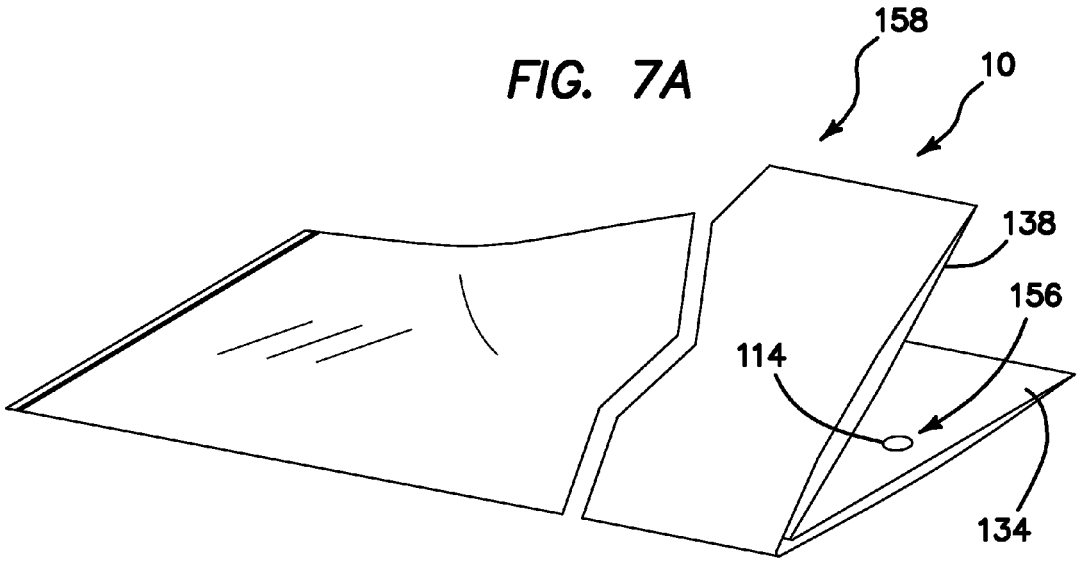

SELF OPENING BAGS WITH ATTACHING FEATURES

RELATED APPLICATION

The instant application is a continuation of PCT application Ser. No. PCT/US11/67515 filed on Dec. 28, 2011 and claims priority to the filing date thereof.

FIELD OF INVENTION

This invention relates to the field of self opening film bags and more specifically to folded and gusseted merchandise and produce bags for which attaching features are provided to outer surfaces of the bags.

BACKGROUND OF THE INVENTION

In supermarkets and grocery stores film bags are used for fresh produce and other grocery items. Such bags provide a low cost, convenient and sanitary method for the collection and transport of otherwise unwrapped food items. Because these bags are usually made of lightweight, very flexible material and because the film used in construction of these bags is often corona treated to enhance ink adhesion, the bag surfaces tend to stick together. This makes the bags difficult to open, often requiring the use of both hands. In order to make the bags easier to use, various systems have been developed to make the bags either self opening or at least easier to open. Some of the inventions that have been developed to provide these features include the following:

U.S. Pat. No. 4,849,090, issued to Case et al., discloses a bag roll of flexible plastic material that is formed in a continuous strip of bags with transverse severance lines between the individual bags. The Patent proposes to solve a familiar problem in the dispensing of plastic film bags from rolls that normally require the use of two hands. In the first place, it is desirable to sever one bag from the roll while stabilizing the remaining portion of the roll so that additional bags are not released as the first bag is severed from the roll. Further, the actual opening of the individual bag is less than convenient since the extremely thin nature of the bag material has a static cling which tends to keep the bag closed. Of specific interest, is the solving of the second problem wherein a releasable adhesive or bonding material is placed between the outer surface of the inner panel of each bag adjacent to the mouth-defining edge and the outer surface of the outer panel of the same or a following bag aligned beneath in the roll. As the first bag is released from the roll, a greater force is provided by the adhesive so that the following bag provides sufficient resistance to allow the leading bag to be severed from the roll while simultaneously holding the remaining portion of the roll in position. As the roll is stabilized by the adhesive only a single hand is necessary to retrieve the bag and at the same time the first bag is simultaneously opened since the adhesive bonding of the inner panel of each bag adjacent to the bag mouth allows for the bag being dispensed to open more easily and thus a single one-hand operation is achieved.

The applied adhesive provides for a releasable adhering or bonding of the inner panel of each bag to the outer panel or panel portions inward thereof in the formed roll. The releasable adhesive bonding allows for the withdrawal of a leading bag from the roll with a resistance to release between the bags which is greater than the resistance required to sever one bag from the roll along the severance line or perforations. Thus, the adhesive provides a resistance to a continued unrolling of the bags while allowing the severance to take place. The opening of the bag is achieved since the adhesive lies solely between the outer surface of the inner panel of each bag and the outer surface of the underlying outer panel. The outer panel of each bag remains free of its associated inner panel at the inward edges and when the user positions the hand over the leading edge portion of the outer panel of the leading bag and the bag is forwardly drawn the mouth automatically is opened in light of the adhesive retained inner panel adjacent the mouth edge thereof. This allows the mouth of the leading bag to be substantially fully opened prior to the release of the associated inner panel adjacent to the leading or mouth defining edge thereof. All of this achieves a single-handed manipulation of the bags so that as it is removed from the roll, the roll is stabilized preventing further unrolling of the following bags and also allowing the dispensed bag to be substantially fully opened.

U.S. Pat. No. 4,904,092, issued to Campbell et al. is directed to a roll of thermoplastic bags with provision of improved openability. The bags include an area of tacky, pressure-sensitive adhesive applied to an outer surface of the bags such that when the bag is pulled from the roll or stack the adhesive temporarily adheres one side of the bag to the roll or stack and thus causes the front and back of the bag to separate slightly thus providing for an easy opening operation. When the bag is dispensed from the roll, the adhesive on the outside back surface of the bag serves to temporarily adhere that surface to the underlying roll. This causes the front and back top ends of the bag to separate slightly when a bag is dispensed. Thus, the openability of the bag is achieved more easily. More specifically, the bag is being dispensed from the stack while adhesive on the outside back surface of bag serves to temporarily adhere that surface to the underlying stack causing the front and back top ends of the bags to separate slightly as the bag is dispensed.

U.S. Patent Application No. 2004/0040974, published for Chen illustrates a plastic bag dispenser and manufacturing method thereof. An adhesive is used on top near the opening of each bag for sticking to the next below bag wherein the closed ends are bent downward toward the openings of the bags so as to form a bent section at the underside of the stack. Thus, when the user exerts a small force to pull one bag from the container through the opening assembly a second bag is prevented from being removed from the stack while as the bag is removed from the box dispenser, the opening is exposed in an open state until the bag is completely removed from the widthwise opening and disengaged from the next bag below which is adhered to the immediately above bag by adhesive until the opening is in an open state. At this point, the top halves of both folded sections and the opening of the next bag below are exposed at the top of the container.

U.S. Pat. No. 7,223,016, issued to Bell disclose a method of opening for bags of supple polymeric material subject to interlayer cling. Bags having openings in or truncated portions of gusset panels create graspable regions which can be tensioned in a direction against a region which is tensioned in another direction thus developing a tension in a first sidewall and a second sidewall allowing for a small amount of tension to cause the first sidewall and second sidewall to sheer in opposite directions and inner layer cling to be disrupted between the graspable regions.

U.S. Pat. No. 3,979,050, issued to Cilla is directed to multiply film articles with provision for readily separating the confronting faces of first and second plies of film. A flexible plastic film bag comprises a ply of flat flexible film superimposed over a second ply of flexible plastic film with edges joined to form a bag with an open end. A portion of the film defines the open end of the bag that is "puckered" such that distortion extends across the full width of open end of the bag. The confronting face of the portion of the film is separated from the confronting face of the opposed portion by the "puckered" distortion in the film. Thus, a means for grasping the bag is provided and the confronting faces of the two films of the bag are easily opened.

U.S. Pat. No. 6,146,017, issued to Hodges is directed to plastic bags having through bores for easy opening. This Patent is another example of a plastic bag that is dispensed from a roll or carton. The bag may have an expandable gusset near one end thereof but the open end has a plurality of through bores that are aligned and extend across the opening for facilitating the opening thereof. The through bores may extend across only one ply of the bag opening or may be offset from one another in both plies such that the bores touch one another and allow for easy opening of the film bag.

It is an objective of the present invention to provide a system for making thin film bags self opening or easier to open. It is a further objective to provide such a system that will allow the user to open the bags with only one hand. It is a still further objective of the invention to provide a system that is not dependant upon the type of dispenser system that the bags are used with. It is yet a further objective to provide a system that can be used with bags that are folded into compact bag rolls or packs. It is another objective to provide an opening system that works with gusseted bags. Finally, it is an objective of the present invention to provide such a system that does not require adhering subsequent bags in a roll or pack together.

While some of the objectives of the present invention are disclosed in the prior art, none of the inventions found include all of the requirements identified.

SUMMARY OF THE INVENTION

The present invention addresses all of the deficiencies of prior art self opening bag inventions and satisfies all of the objectives described above.

(1) A self opening bag providing the desired features may be constructed from the following components. A front wall is provided. The front wall has an inner surface, an outer surface, first and second side edges, a top edge and a bottom edge. A rear wall is provided. The rear wall has an inner surface, an outer surface, first and second side edges, a top edge and a bottom edge. The front wall is joined to the rear wall adjacent respective first and second side edges thereof. The front wall is sealed to the rear wall adjacent respective bottom edges thereof. An open mouth is located adjacent the top edges. The bag is folded twice parallel to the side edges to form a Z-folded bag approximately one third of a width of the bag.

The outer surface of the front wall has first, second and third portions. Each of the portions has an upper end adjacent the open mouth. The outer surface of the rear wall has fourth, fifth and sixth portions. Each of the portions has an upper end adjacent the open mouth. At least one attaching feature is provided. The attaching feature is located at at least one of a first point between the second portion and the third portion adjacent the upper end and a second point between the fourth portion and the fifth portion adjacent the upper end. The bag is releasably attached to a subsequent bag. The at least one attaching feature causes the bag to open as the bag is pulled from the subsequent bag. The attaching feature may be a natural or synthetic substance or other attaching means not requiring a separate substance. It may be sprayed, rolled or dropped on the outer bag surfaces or may involve mechanical or electrical manipulation of the bag surfaces.

(2) In a variant of the invention, a front wall is provided. The front wall has an inner surface, an outer surface, first and second side edges, a top edge and a bottom edge. A rear wall is provided. The rear wall has an inner surface, an outer surface, first and second side edges, a top edge and a bottom edge. The front wall is joined to the rear wall adjacent respective first and second side edges thereof. The front wall is sealed to the rear wall adjacent respective bottom edges thereof. An open mouth is located adjacent the top edges. The bag is folded twice parallel to the side edges to form a C-folded bag approximately one third of a width of the bag. The outer surface of the front wall has first, second and third portions.

Each of the portions has an upper end adjacent the open mouth. The outer surface of the rear wall has fourth, fifth and sixth portions. Each of the portions has an upper end adjacent the open mouth. At least one attaching feature is provided. The attaching feature is located at at least one of a first point between the first portion and the sixth portion adjacent the upper end and a second point between the second portion and the third portion adjacent the upper end. The bag is releasably attached to a subsequent bag. The at least one attaching feature causes the bag to open as the bag is pulled from the subsequent bag.

(3) In another variant, a front wall is provided. The front wall has an inner surface, an outer surface, first and second side edges, a top edge and a bottom edge. A rear wall is provided. The rear wall has an inner surface, an outer surface, first and second side edges, a top edge and a bottom edge. The front wall is joined to the rear wall adjacent respective first and second side edges thereof. The front wall is sealed to the rear wall adjacent respective bottom edges thereof. The bag is folded once parallel to the side edges to form a folded bag approximately one half of a width of the bag. An open mouth is located adjacent the top edges. The outer surface of the front wall has first and second portions. Each of the portions has an upper end adjacent the open mouth. The outer surface of the rear wall has third and fourth portions. Each of the portions has an upper end adjacent the open mouth. At least one attaching feature is provided. The attaching feature is located at a point between the first portion and the second portion adjacent the upper end. The bag is releasably attached to a subsequent bag. The at least one attaching feature causes the bag to open as the bag is pulled from the subsequent bag.

(4) In still another variant, a front wall is provided. The front wall has an inner surface, an outer surface, first and second side edges, a top edge and a bottom edge. A rear wall is provided. The rear wall has an inner surface, an outer surface, first and second side edges, a top edge and a bottom edge. The front wall is joined to the rear wall adjacent respective first and second side edges thereof. The bag is folded once parallel to the side edges to form a folded bag approximately one half of a width of the bag. The front wall is sealed to the rear wall adjacent respective bottom edges thereof. An open mouth is located adjacent the top edges. The outer surface of the front wall has first and second portions. Each of the portions has an upper end adjacent the open mouth. The outer surface of the rear wall has third and fourth portions. Each of the portions has an upper end adjacent the open mouth. At least one attaching feature is provided. The attaching feature is located at a point between the first portion and the second portion adjacent the upper end. The bag is releasably attached to a subsequent bag. The at least one attaching feature causes the bag to open as the bag is pulled from the subsequent bag.

(5) In yet another variant, a front wall is provided. The front wall has an inner surface, an outer surface, first and second side edges, a top edge and a bottom edge. A rear wall is provided. The rear wall has an inner surface, an outer surface, first and second side edges, a top edge and a bottom edge. The front wall is joined to the rear wall adjacent respective first and second side edges thereof. The front wall is sealed to the rear wall adjacent respective bottom edges thereof. The bag is folded at least once parallel to the side edges along at least one vertical fold line to form a folded bag has a width less than an unfolded width of the bag. An open mouth is located adjacent the top edges. The outer surface of the front wall is divided into at least two portions along the vertical fold lines. Each of the portions has an upper end adjacent the open mouth. The outer surface of the rear wall is divided into at least two portions along the vertical fold lines. Each of the portions has an upper end adjacent the open mouth. At least one attaching feature is provided. The attaching feature is located at a point between at least one adjacent pair of the portions adjacent the upper end. The bag is releasably attached to a subsequent bag. The at least one attaching feature causes the bag to open as the bag is pulled from the subsequent bag.

(6) In a further variant, a front wall is provided. The front wall has an inner surface, an outer surface, first and second side edges, a top edge and a bottom edge. A rear wall is provided. The rear wall has an inner surface, an outer surface, first and second side edges, a top edge and a bottom edge. The front wall is joined to the rear wall adjacent respective first and second side edges thereof. The bag is folded at least once parallel to the side edges along at least one vertical fold line to form a folded bag has a width less than an unfolded width of the bag. An open mouth is located adjacent the top edges. The front wall is sealed to the rear wall adjacent respective bottom edges thereof. The outer surface of the front wall is divided into at least two portions along the vertical fold lines. Each of the portions has an upper end adjacent the open mouth. The outer surface of the rear wall is divided into at least two portions along the vertical fold lines. Each of the portions has an upper end adjacent the open mouth. At least one attaching feature is provided. The attaching feature is located at a point between at least one adjacent pair of the portions adjacent the upper end. The bag is releasably attached to a subsequent bag. The at least one attaching feature causes the bag to open as the bag is pulled from the subsequent bag.

(7) In still a further variant, the front and rear walls of each of the bags is removably attached by a perforation line at the bottom edges to the top edges of the subsequent bag.

(8) In yet a further variant, the bags are rolled to form a compact bag roll.

(9) In another variant, the bags include a chisel cut. The chisel cut extends through a center point of the perforation line. When the compact roll is installed in a bag dispenser the chisel cut will engage a separating tongue when bags are pulled from the roll.

(10) In still another variant, the bags are rolled about a core.

(11) In yet another variant, the bags include at least one side gusset. The side gusset extends inwardly from at least one of the first and second side edges of the front and rear walls.

(12) In another variant of the invention, the side gusset extends inwardly from at least one of the first and second side edges of the front and rear walls for up to one third of the width of the bags.

(13) In still another variant, the side gusset extends inwardly from at least one of the first and second side edges of the front and rear walls for up to one half of the width of the bags.

(14) In yet another variant, the bag further includes a bottom gusset. The bottom gusset extends upwardly from the bottom edges.

(15) In a further variant, the outer surface of at least one of the front wall and the rear wall of the bags is corona treated.

(16) In still a further variant, the corona treatment of the outer surface of at least one of the front and rear walls of each of the bags is an amount sufficient to result in a surface tension on the wall of at least about 38 dynes/cm.

(17) In yet a further variant, the outer surface of at least one of the front wall and the rear wall of the bags is printed.

(18) In another variant, the bags are formulated from about 40-48 wt. % high density, high molecular weight polyethylene, 12-20 wt. % high density, medium molecular weight polyethylene, 20-30 wt. % linear low density polyethylene, 0-8 wt. % color concentrate.

(19) In still another variant, the bags are formulated from about 10-20 wt. % recycled material, the recycled material includes about 40-48 wt. % high density, high molecular weight polyethylene, 12-20 wt. % high density, medium molecular weight polyethylene, 20-30 wt. % linear low density polyethylene, 0-8 wt. % color concentrate.

(20) In yet another variant, 10-15 wt. % of the linear low density polyethylene has a density ranging from 0.923-0.924 gm/cc.

(21) In a further variant, 10-15 wt. % of the linear low density polyethylene has a melt index ranging from 0.25-0.30 gm/10 minutes.

(22) In still a further variant, the high density, medium molecular weight polyethylene has a density ranging from 0.937-0.947 gm/cc.

(23) In yet a further variant, the high density, medium molecular weight polyethylene has a melt index ranging from 0.10-0.30 gm/10 minutes.

(24) In another variant of the invention, the bags are removably attached to a header.

(25) In still another variant, the bags are removably attached to the header at a perforation line.

(26) In yet another variant, an upper seam is provided. The seam seals the front wall to the rear wall adjacent the top edges. A U-shaped cut-out is provided. The cut-out commences at a first point on the top edges spaced inwardly from the first side edges, extends downwardly toward the bottom edges, extends inwardly toward the second side edges and continues upwardly to a second point on the top edges spaced inwardly from the second side edges. The cut-out forms an open bag mouth and a pair of bag handles that terminate at the upper seam.

(27) In a further variant, the bags are formed into a registered bag stack.

(28) In still a further variant, each of the bags is releasably attached to a subsequent bag in the bag stack using a method selected from the group that includes cold staking, hot pinning, multiple corona treatment, corona treatment with pressure points, knife cutting, special resin formulations, and glue spotting.

(29) In yet a further variant, at least one of the bag stacks is secured within a flexible covering. The covering has an aperture for removal of bags from the at least one bag stack.

(30) In another variant of the invention, a container is provided. The container is sized and shaped to slidably enclosed at least one of the bag stacks. The container has an aperture for removal of the bags from the at least one bag stack.

(31) In still another variant, each of the bags has a dispensed portion and a remaining portion. The remaining portion is secured within the container.

(32) In a final variant, at least one bag stack located within the flexible covering is located within the container.

An appreciation of the other aims and objectives of the present invention and an understanding of it may be achieved by referring to the accompanying drawings and the detailed description of a preferred embodiment.

DESCRIPTION OF THE DRAWINGS

FIG. 2 is a perspective view of a C-fold Tri-fold bag with attaching features;

FIG. 2A is a perspective view of the FIG. 2 embodiment being folded;

FIG. 7 is a perspective view of a once folded rectangular bag with attaching feature prior to folding;

FIG. 7A is a perspective view of the FIG. 7 embodiment with bottom sealed after being folded;

DETAILED DESCRIPTION OF THE PREFERRED EMBODIMENT (1) FIGS. 1-16 illustrate a self opening bag 10 providing the desired features that may be constructed from the following components. As illustrated in FIGS. 1 and 1A, a front wall 14 is provided. The front wall 14 has an inner surface 18, an outer surface 22, first 26 and second 30 side edges, a top edge 34 and a bottom edge 38. A rear wall 42 is provided. The rear wall 42 has an inner surface 46, an outer surface 50, first 54 and second 58 side edges, a top edge 62 and a bottom edge 66. The front wall 14 is joined to the rear wall 42 adjacent respective first 26, 54 and second 30, 58 side edges thereof. The front wall 14 is sealed to the rear wall 42 adjacent respective bottom edges 38, 66 thereof. An open mouth 70 is located adjacent the top edges 34, 62. The bag 10 is folded twice parallel to the side edges 26, 54, 30, 58 to form a Z-folded bag 74 approximately one third of a width 78 of the bag 10.

Figure 1:
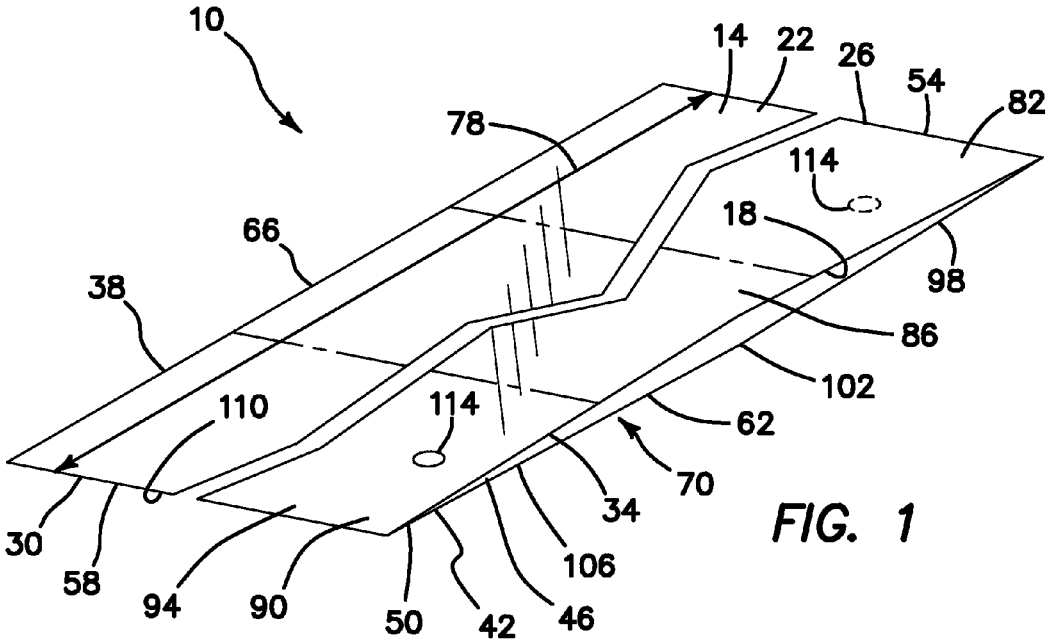
FIG. 1 is a perspective view of a Z-fold Tri-fold bag with attaching features.
Figure 1A:
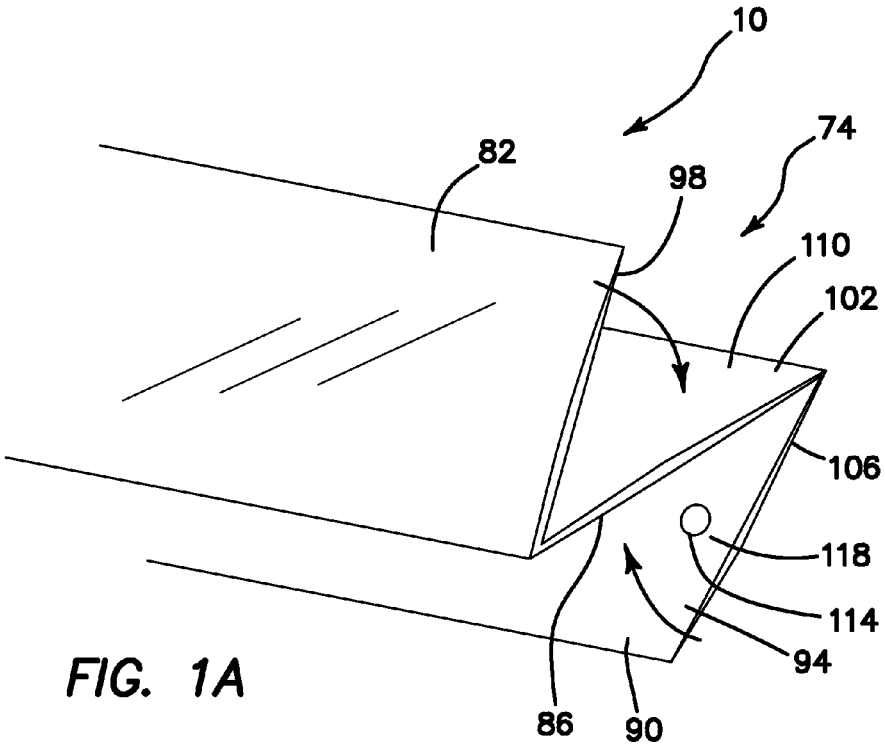
FIG. 1A is a perspective view of the FIG. 1 embodiment being folded.

The outer surface 22 of the front wall 14 has first 82, second 86 and third 90 portions. Each of the portions 82, 86, 90 has an upper end 94 adjacent the open mouth 70. The outer surface 50 of the rear wall 42 has fourth 98, fifth 102 and sixth 106 portions. Each of the portions 98, 102, 106 has an upper end 110 adjacent the open mouth 70. At least one attaching feature 114 is provided. The attaching feature 114 is located at at least one of a first point 118 between the second portion 86 and the third 90 portion adjacent the upper end 94 and a second point 122 between the fourth portion 98 and the fifth 102 portion adjacent the upper end 110. The bag 10 is releasably attached to a subsequent bag 10. The at least one attaching feature 114 causes the bag 74 to open as the bag 74 is pulled from the subsequent bag 74.

(2) In a variant of the invention, as illustrated in FIGS. 2, 2A-2D, a front wall 14 is provided. The front wall 14 has an inner surface 18, an outer surface 22, first 26 and second 30 side edges, a top edge 34 and a bottom edge 38. A rear wall 42 is provided. The rear wall 42 has an inner surface 46, an outer surface 50, first 54 and second 58 side edges, a top edge 62 and a bottom edge 66. The front wall 14 is joined to the rear wall 42 adjacent respective first 26, 54 and second 30, 58 side edges thereof. The front wall 14 is sealed to the rear wall 42 adjacent respective bottom edges 38, 66 thereof. An open mouth 70 is located adjacent the top edges 34, 62. The bag 10 is folded twice parallel to the side edges 26, 54, 30, 58 to form a C-folded bag 126 approximately one third of a width 78 of the bag 10.

The outer surface 22 of the front wall 14 has first 82, second 86 and third 90 portions. Each of the portions 82, 86, 90 has an upper end 94 adjacent the open mouth 70. The outer surface 50 of the rear wall 42 has fourth 98, fifth 102 and sixth 106 portions. Each of the portions 98, 102, 106 has an upper end 110 adjacent the open mouth 70. At least one attaching feature 114 is provided. The attaching feature 114 is located at at least one of a first point 118 between the first portion 82 and the sixth portion 106 adjacent the upper end 94, 110 and a second point 122 between the second portion 86 and the third portion 90 adjacent the upper end 94, 110. The bag 10 is releasably attached to a subsequent bag 10. The at least one attaching feature 114 causes the bag 126 to open as the bag 126 is pulled from the subsequent bag 126.

Figure 5:
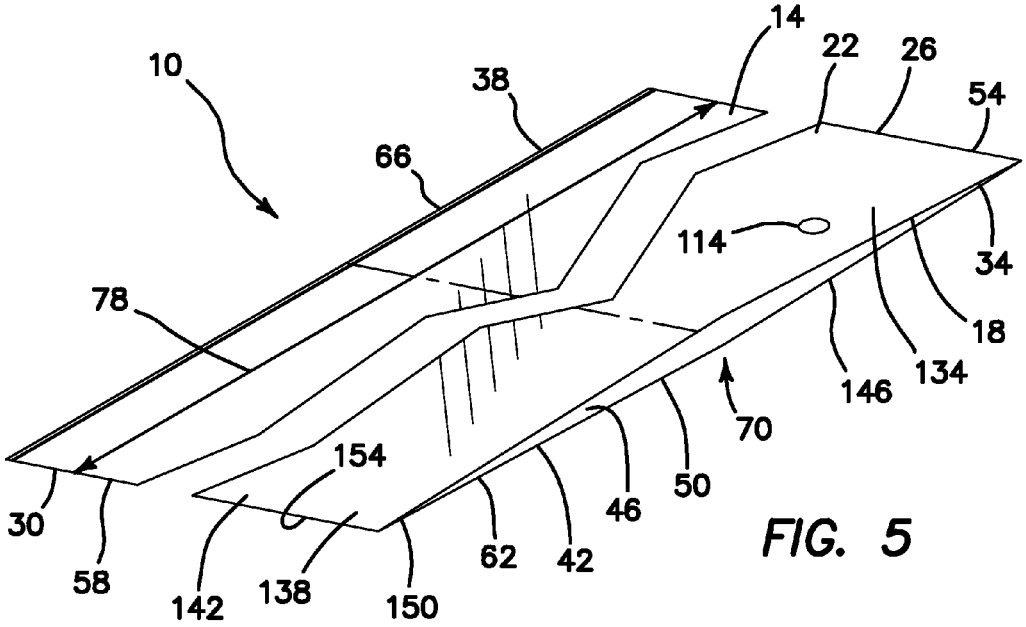
FIG. 5 is a perspective view of a once folded rectangular bag with attaching feature.
Figure 5A:
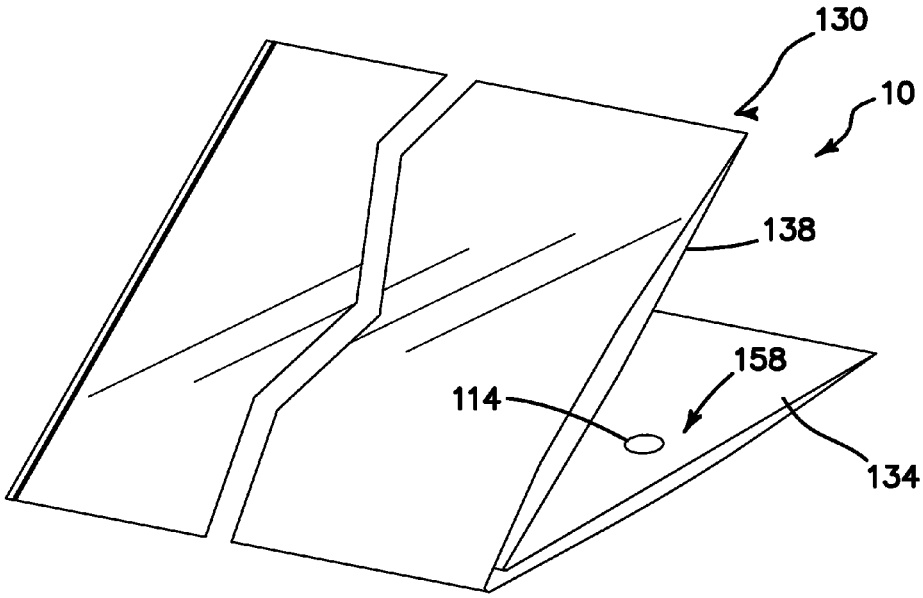
FIG. 5A is a perspective view of the FIG. 5 embodiment being folded.
Figure 6:
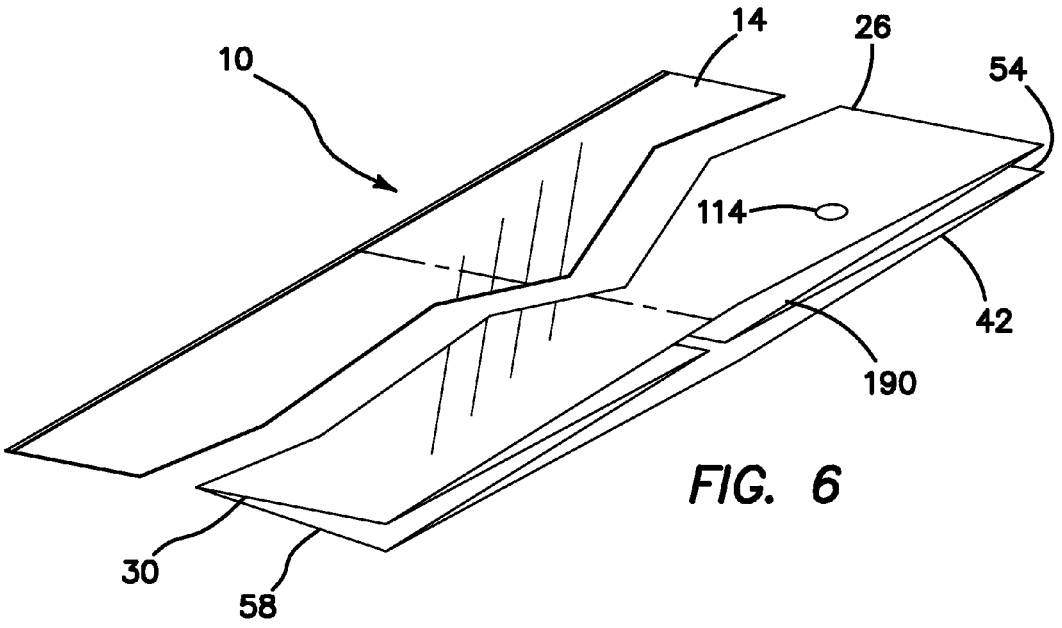
FIG. 6 is a perspective view of a once folded, gusseted rectangular bag with attaching feature.
Figure 6A:
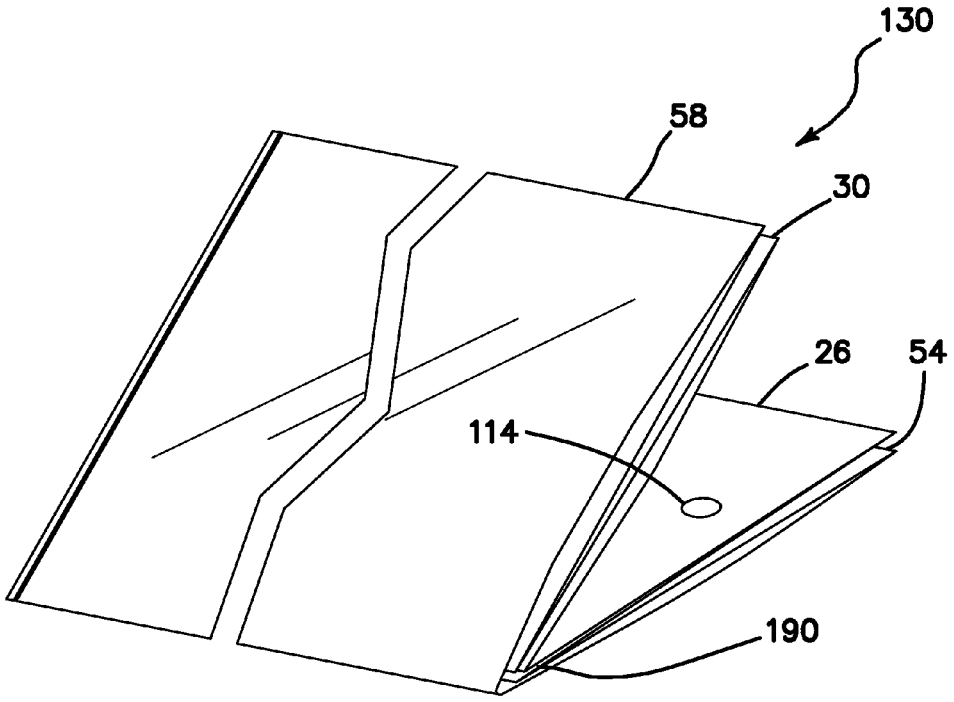
FIG. 6A is a perspective view of the FIG. 6 embodiment being folded.

(3) In another variant, as illustrated in FIGS. 5 and 5A, a front wall 14 is provided. The front wall 14 has an inner surface 18, an outer surface 22, first 26 and second 30 side edges, a top edge 34 and a bottom edge 38. A rear wall 42 is provided. The rear wall 42 has an inner surface 46, an outer surface 50, first 54 and second 58 side edges, a top edge 62 and a bottom edge 66. The front wall 14 is joined to the rear wall 42 adjacent respective first 26, 54 and second 30, 58 side edges thereof. The front wall 14 is sealed to the rear wall 42 adjacent respective bottom edges 38, 66 thereof. The bag 10 is folded once parallel to the side edges 26, 54, 30, 58 to form a folded bag 130 approximately one half of a width 78 of the bag 10. An open mouth 70 is located adjacent the top edges 34, 62. The outer surface 22 of the front wall 14 has first 134 and second 138 portions. Each of the portions 134, 138 has an upper end 142 adjacent the open mouth 70. The outer surface 50 of the rear wall 42 has third 146 and fourth 150 portions. Each of the portions 146, 150 has an upper end 154 adjacent the open mouth 70. At least one attaching feature 114 is provided. The attaching feature 114 is located at a point 158 between the first portion 134 and the second portion 138 adjacent the upper end 142. The bag 130 is releasably attached to a subsequent bag 130. The at least one attaching feature 114 causes the bag 130 to open as the bag 130 is pulled from the subsequent bag 130.

Figure 8:
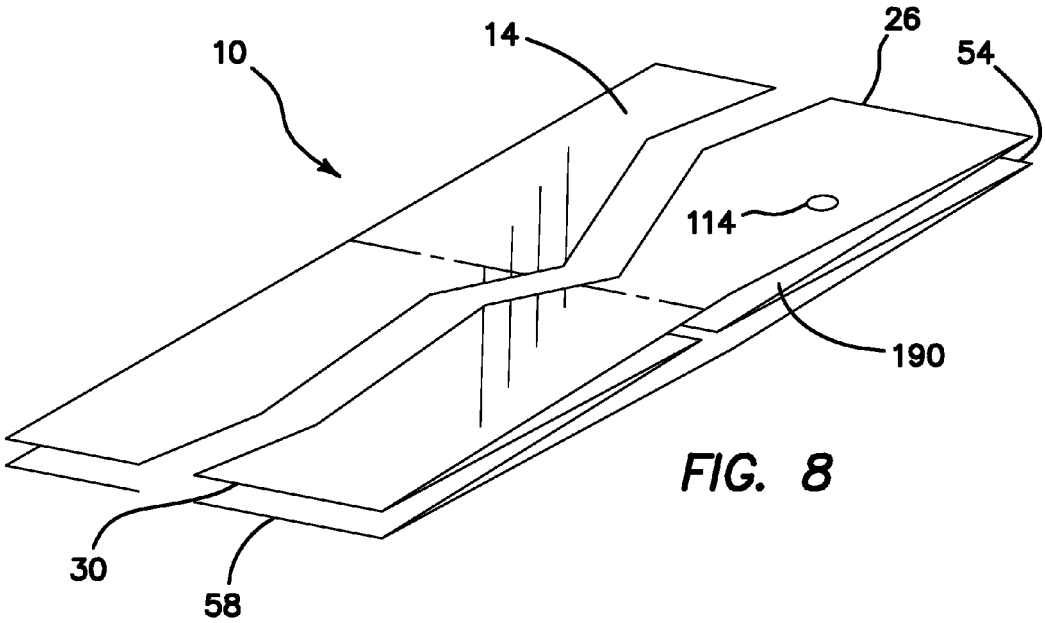
FIG. 8 is a perspective view of a once folded, gusseted rectangular bag with attaching feature prior to folding.
Figure 8A:
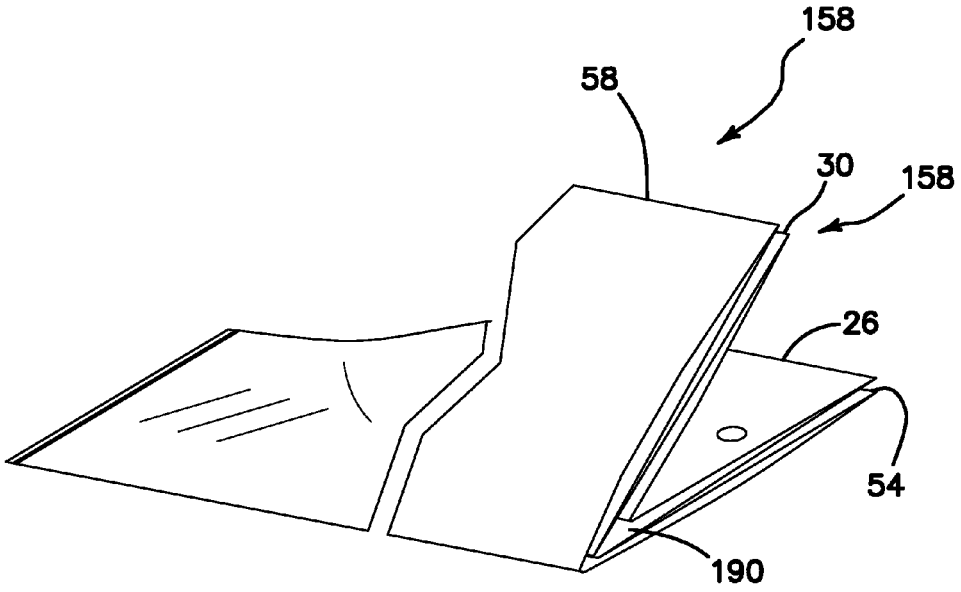
FIG. 8A is a perspective view of the FIG. 8 embodiment with bottom sealed after being folded.
Figure 8B:
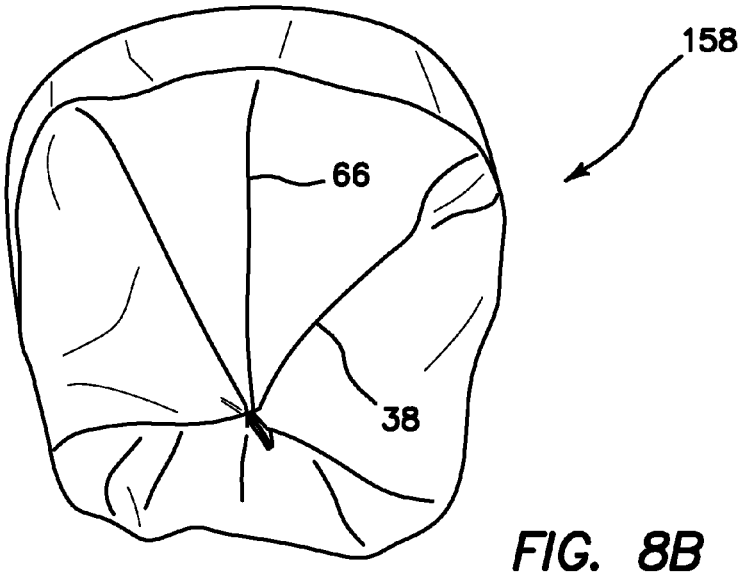
FIG. 8B is a bottom side perspective view of the FIG. 8 embodiment after bag opening.

(4) In still another variant, as illustrated in FIGS. 7, 7A and 8B, a front wall 14 is provided. The front wall 14 has an inner surface 18, an outer surface 22, first 26 and second 30 side edges, a top edge 34 and a bottom edge 38. A rear wall 42 is provided. The rear wall 42 has an inner surface 46, an outer surface 50, first 54 and second 58 side edges, a top edge 62 and a bottom edge 66. The front wall 14 is joined to the rear wall 42 adjacent respective first 26, 54 and second 30, 58 side edges thereof. The bag 10 is folded once parallel to the side edges 26, 54, 30, 58 to form a folded bag 158 approximately one half of a width 78 of the bag 10. The front wall 14 is sealed to the rear wall 42 adjacent respective bottom edges 38, 66 thereof. An open mouth 70 is located adjacent the top edges 34, 62. The outer surface 22 of the front wall 14 has first 134 and second 138 portions. Each of the portions 134, 138 has an upper end 142 adjacent the open mouth 70. The outer surface 50 of the rear wall 42 has third 146 and fourth 150 portions. Each of the portions 146, 150 has an upper end 154 adjacent the open mouth 70. At least one attaching feature 114 is provided. The attaching feature 114 is located at a point 156 between the first portion 134 and the second portion 138 adjacent the upper end 142. The bag 158 is releasably attached to a subsequent bag 158. The at least one attaching feature 114 causes the bag 158 to open as the bag 158 is pulled from the subsequent bag 158.

Figure 9:
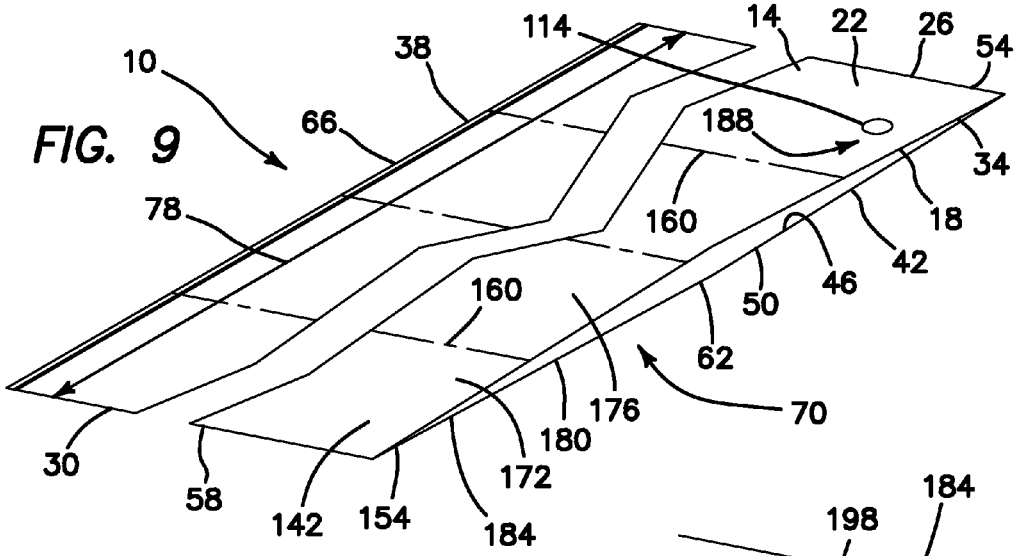
FIG. 9 is a perspective view of a multi-fold bag with attaching feature that is sealed prior to folding.
Figure 9A:
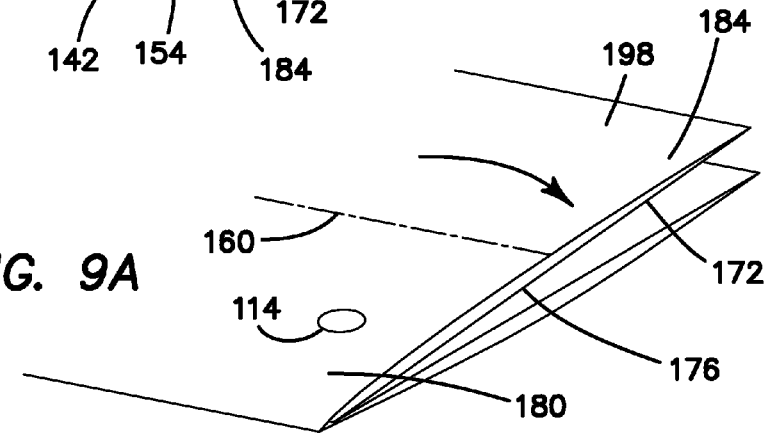
FIG. 9A is a perspective view of the FIG. 9 embodiment partially folded.
Figure 9B:
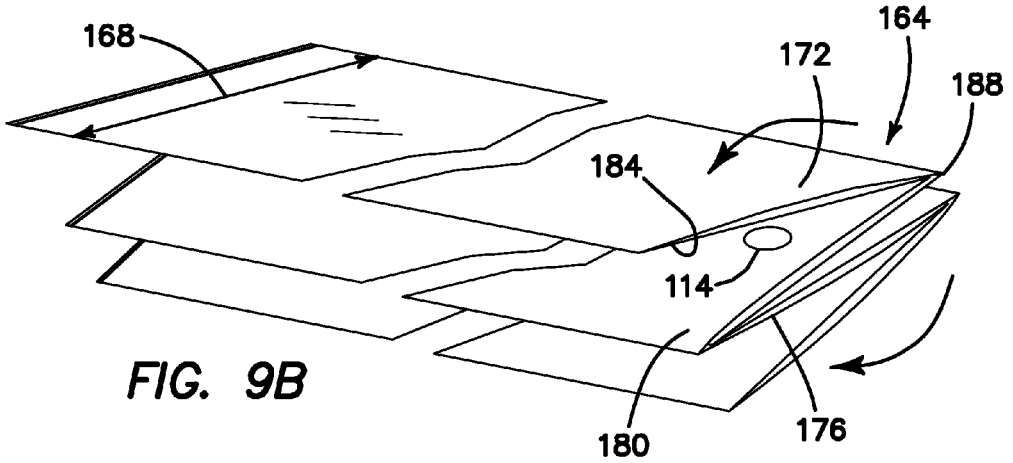
FIG. 9B is a perspective view of the FIG. 9 embodiment after folding.

(5) In yet another variant, as illustrated in FIGS. 9, 9A and 9B, a front wall 14 is provided. The front wall 14 has an inner surface 18, an outer surface 22, first 26 and second 30 side edges, a top edge 34 and a bottom edge 38. A rear wall 42 is provided. The rear wall 42 has an inner surface 46, an outer surface 50, first 54 and second 58 side edges, a top edge 62 and a bottom edge 66. The front wall 14 is joined to the rear wall 42 adjacent respective first 26, 54 and second 30, 58 side edges thereof. The front wall 14 is sealed to the rear wall 42 adjacent respective bottom edges 38, 66 thereof. An open mouth 70 is located adjacent the top edges 34, 62. The bag 10 is folded at least once parallel to the side edges 26, 54, 30, 58 along at least one vertical fold line 160 to form a folded bag 164 that has a width 168 less than an unfolded width 78 of the bag 10. The outer surface 22 of the front wall 14 is divided into at least two portions 172, 176 along the vertical fold lines 160. Each of the portions 172, 176 has an upper end 142 adjacent the open mouth 70. The outer surface 50 of the rear wall 42 is divided into at least two portions 180, 184 along the vertical fold lines 160. Each of the portions 180, 184 has an upper end 154 adjacent the open mouth 70. At least one attaching feature 114 is provided. The attaching feature 114 is located at a point 188 between at least one adjacent pair of the portions 172, 176, 180, 184 adjacent the upper end 142, 154. The bag 164 is releasably attached to a subsequent bag 164. The at least one attaching feature 114 causes the bag 164 to open as the bag 164 is pulled from the subsequent bag 164.

Figure 10:
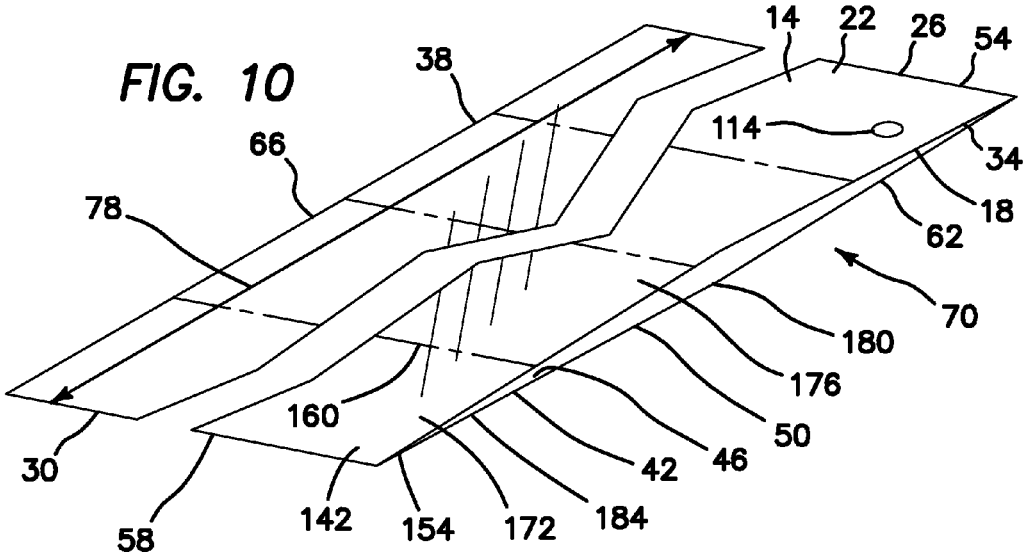
FIG. 10 is a perspective view of a multi-fold bag with attaching feature that is sealed after folding.
Figure 10A:
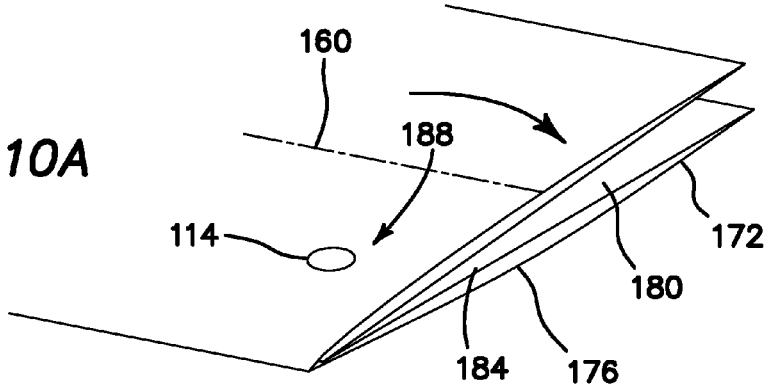
FIG. 10A is a perspective view of the FIG. 10 embodiment partially folded.
Figure 10B:
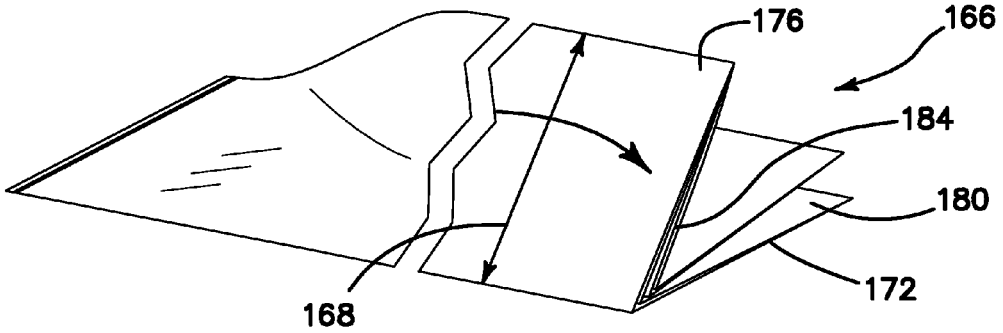
FIG. 10B is a perspective view of the FIG. 10 embodiment after folding.

(6) In a further variant, as illustrated in FIGS. 10, 10A and 10B, a front wall 14 is provided. The front wall 14 has an inner surface 18, an outer surface 22, first 26 and second 30 side edges, a top edge 34 and a bottom edge 38. A rear wall 42 is provided. The rear wall 42 has an inner surface 46, an outer surface 50, first 54 and second 58 side edges, a top edge 62 and a bottom edge 66. The front wall 14 is joined to the rear wall 42 adjacent respective first 26, 54 and second 30, 58 side edges thereof. An open mouth 70 is located adjacent the top edges 34, 62. The bag 10 is folded at least once parallel to the side edges 26, 54, 30, 58 along at least one vertical fold line 160 to form a folded bag 166 that has a width 168 less than an unfolded width 78 of the bag 10. The front wall 14 is sealed to the rear wall 42 adjacent respective bottom edges 38, 66 thereof. The outer surface 22 of the front wall 14 is divided into at least two portions 172, 176 along the vertical fold lines 160. Each of the portions 172, 176 has an upper end 142 adjacent the open mouth 70. The outer surface 50 of the rear wall 42 is divided into at least two portions 180, 184 along the vertical fold lines 160. Each of the portions 180, 184 has an upper end 154 adjacent the open mouth 70. At least one attaching feature 114 is provided. The attaching feature 114 is located at a point 188 between at least one adjacent pair of the portions 172, 176, 180, 184 adjacent the upper end 142, 154. The bag 166 is releasably attached to a subsequent bag 166. The at least one attaching feature 114 causes the bag 166 to open as the bag 166 is pulled from the subsequent bag 166.

Figure 2B:
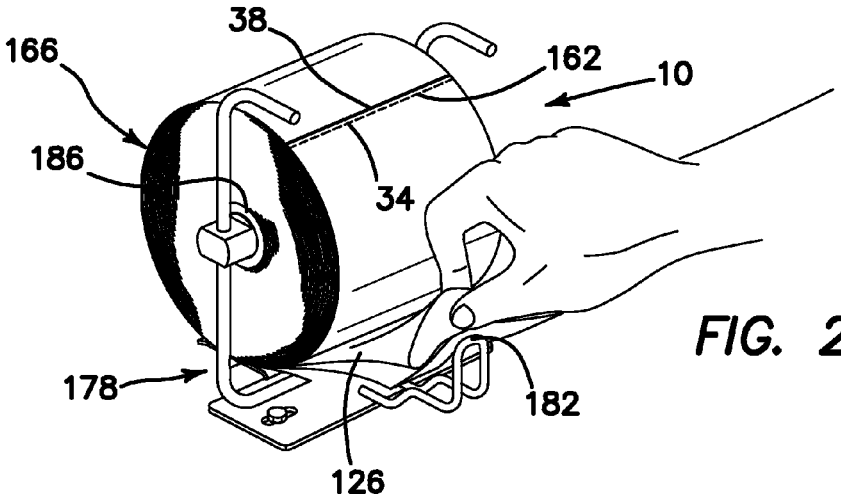
FIG. 2B is a perspective view of a compact roll of FIG. 1 bags in a dispenser illustrating the self opening feature.

(7) In still another variant, as illustrated in FIG. 2B, the front 14 and rear 42 walls of each of the bags 10 is removably attached by a perforation line 162 at the bottom edges 38, 66 to the top edges 34, 62 of the subsequent bag 10.

(8) In yet another variant, the bags 10 are rolled to form a compact bag roll 166.

Figure 2C:
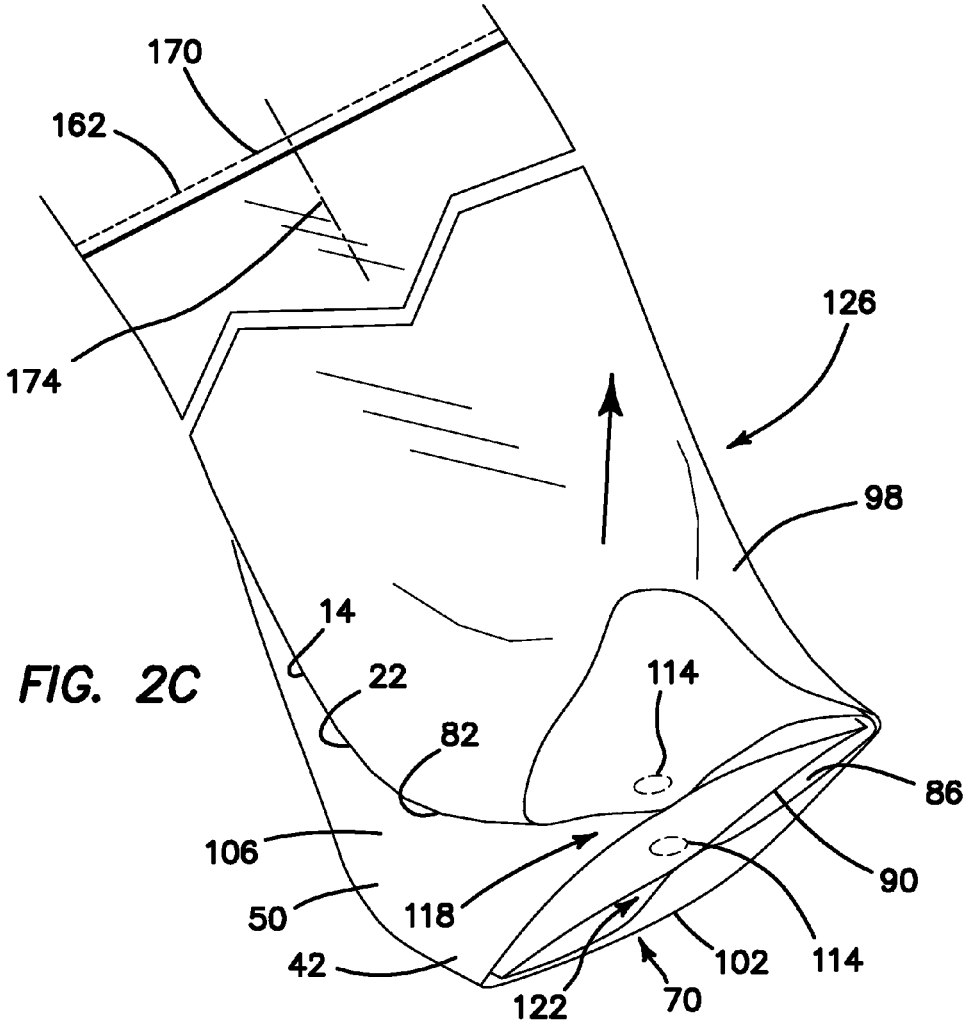
FIG. 2C is a perspective view of the FIG. 1 embodiment illustrating joined attaching features during opening of the bag.
Figure 2D:
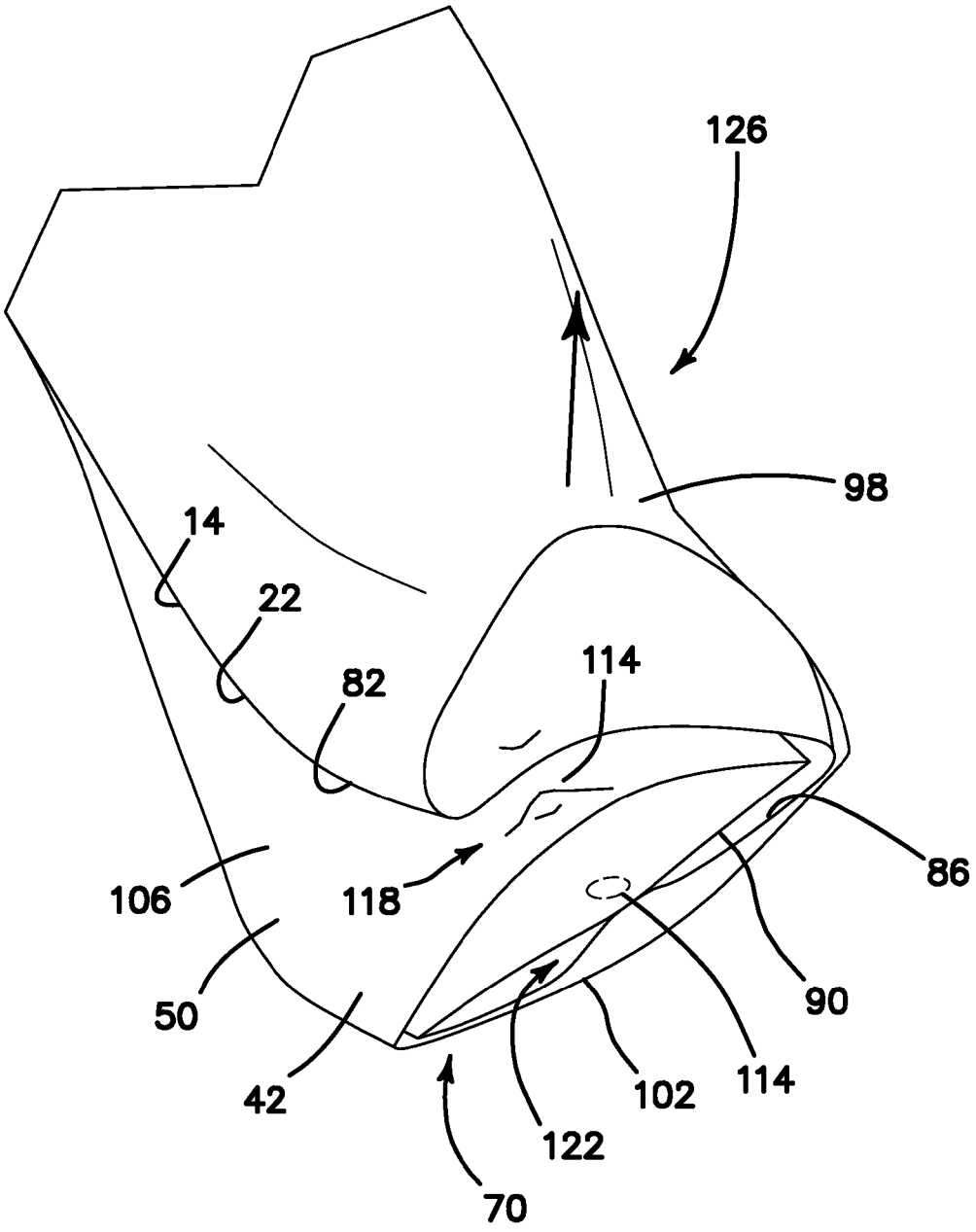
FIG. 2D is a perspective view of the FIG. 1 embodiment illustrating the parting of an attaching feature during bag opening.

(9) In a further variant, as illustrated in FIG. 2C, the bags 10 include a chisel cut 170. The chisel cut 170 extends through a center point 174 of the perforation line 162. When the compact roll 166 is installed in a bag dispenser 178 the chisel cut 170 will engage a separating tongue 182 when bags 10 are pulled from the roll 166.

(10) In still a further variant, the bags 10 are rolled about a core 186.

(11) In yet a further variant, as illustrated in FIGS. 3, 3A, 6, 6A, 8 and 8A, the bags 10 include at least one side gusset 190.

The side gusset 190 extends inwardly from at least one of the first 26, 54 and second 30, 58 side edges of the front 14 and rear 42 walls.

Figure 3:
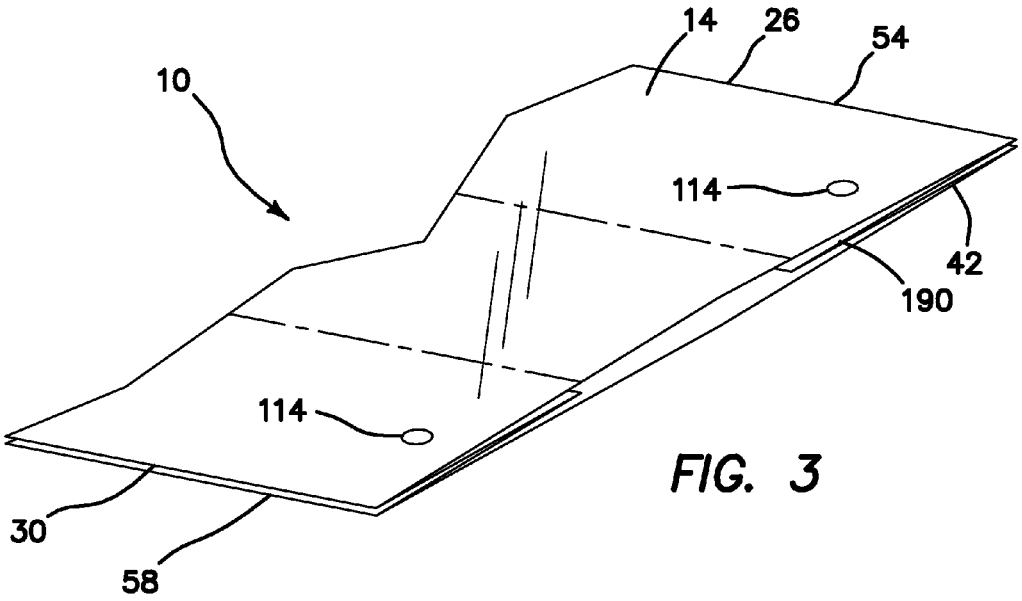
FIG. 3 is a perspective view of a gusseted C-fold Tri-fold bag with attaching features.
Figure 3A:
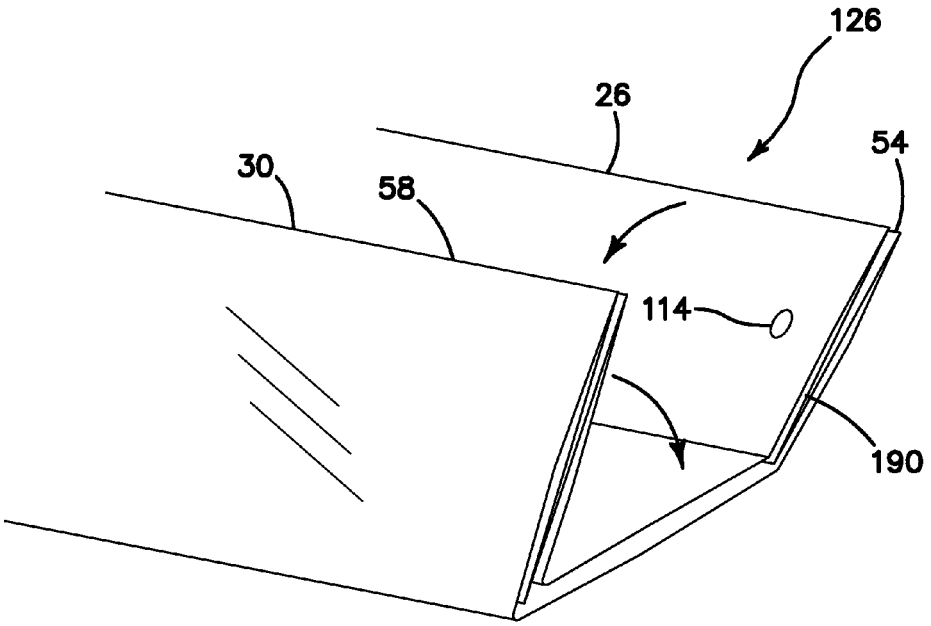
FIG. 3A is a perspective view of the FIG. 3 embodiment being folded.
Figure 4:
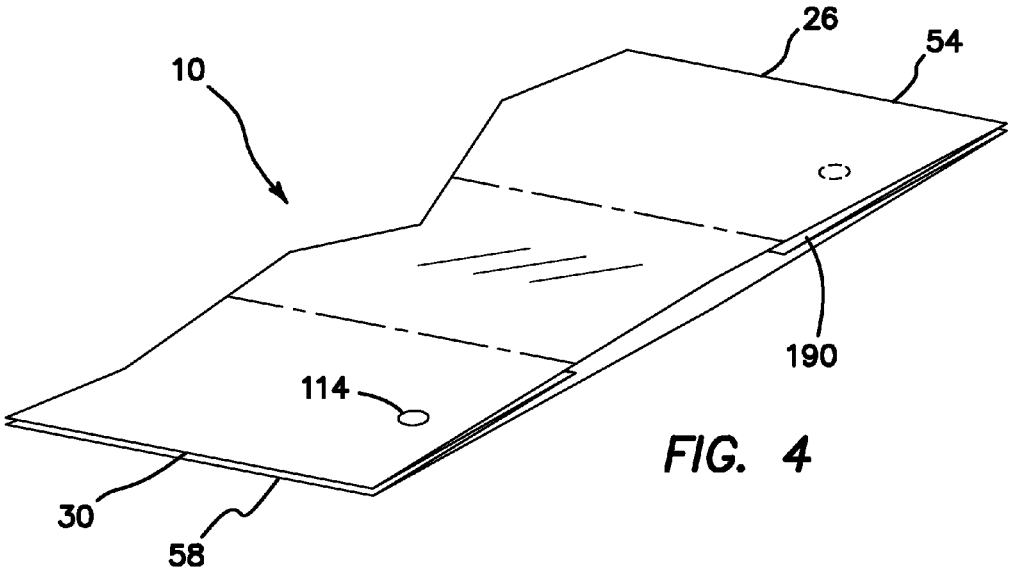
FIG. 4 is a perspective view of a gusseted Z-fold Tri-fold bag with attaching features.
Figure 4A:
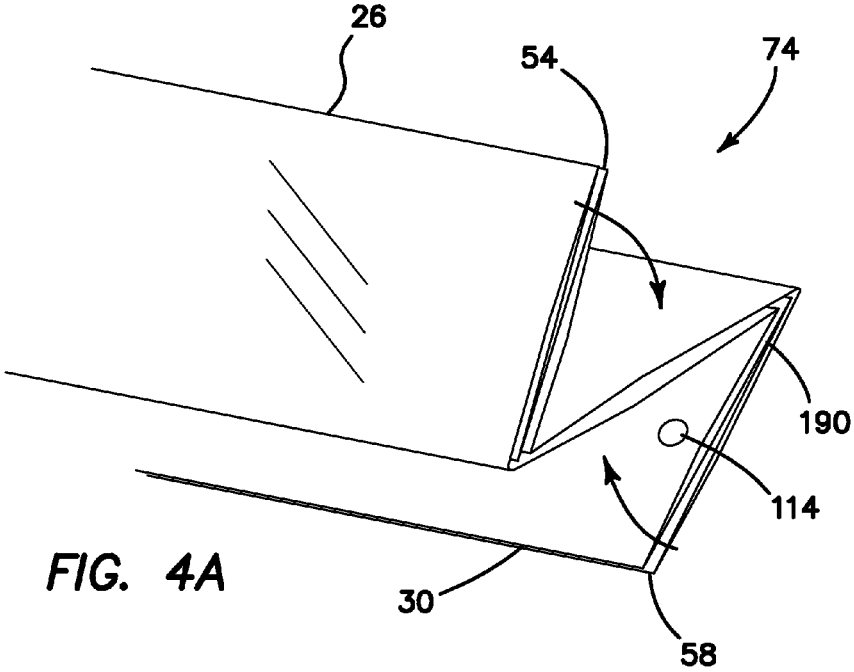
FIG. 4A is a perspective view of the FIG. 4 embodiment being folded.

(12) In another variant of the invention, as illustrated in FIGS. 3 and 4, the side gusset 190 extends inwardly from at least one of the first 26, 54 and second 30, 58 side edges of the front 14 and rear 42 walls for up to one third of the width 78 of the bags 10.

(13) In still another variant, as illustrated in FIGS. 6, 6A, 8 and 8A, the side gusset 190 extends inwardly from at least one of the first 26, 54 and second 30, 58 side edges of the front 14 and rear 42 walls for up to one half of the width 78 of the bags 10.

(14) In yet another variant, as illustrated in FIGS. 16, 16A, 16B and 16C, the bag 10 further includes a bottom gusset 194. The bottom gusset 194 extends upwardly from the bottom edges 38, 66.

(15) In a further variant, as illustrated in FIG. 9A, the outer surface 22, 50 of at least one of the front wall 14 and the rear wall 42 of the bags 10 is corona treated 198.

(16) In still a further variant, the corona treatment 198 of the outer surface 22, 50 of at least one of the front wall 14 and the rear wall 42 of each of the bags 10 is an amount sufficient to result in a surface tension on the wall 14, 42 of at least about 38 dynes/cm.

(17) In yet a further variant, the outer surface of at least one of the front wall and the rear wall of the bags is printed.

(18) In another variant, the bags 10 are formulated from about 40-48 wt. % high density, high molecular weight polyethylene, 12-20 wt. % high density, medium molecular weight polyethylene, 20-30 wt. % linear low density polyethylene, 0-8 wt. % color concentrate.

(19) In still another variant, the bags 10 are formulated from about 10-20 wt. % recycled material, the recycled material includes about 40-48 wt. % high density, high molecular weight polyethylene, 12-20 wt. % high density, medium molecular weight polyethylene, 20-30 wt. % linear low density polyethylene, 0-8 wt. % color concentrate.

(20) In yet another variant, 10-15 wt. % of the linear low density polyethylene has a density ranging from 0.923-0.924 gm/cc.

(21) In a further variant, 10-15 wt. % of the linear low density polyethylene has a melt index ranging from 0.25-0.30 gm/10 minutes.

(22) In still a further variant, the high density, medium molecular weight polyethylene has a density ranging from 0.937-0.947 gm/cc.

(23) In yet a further variant, the high density, medium molecular weight polyethylene has a melt index ranging from 0.10-0.30 gm/10 minutes.

Figure 12:
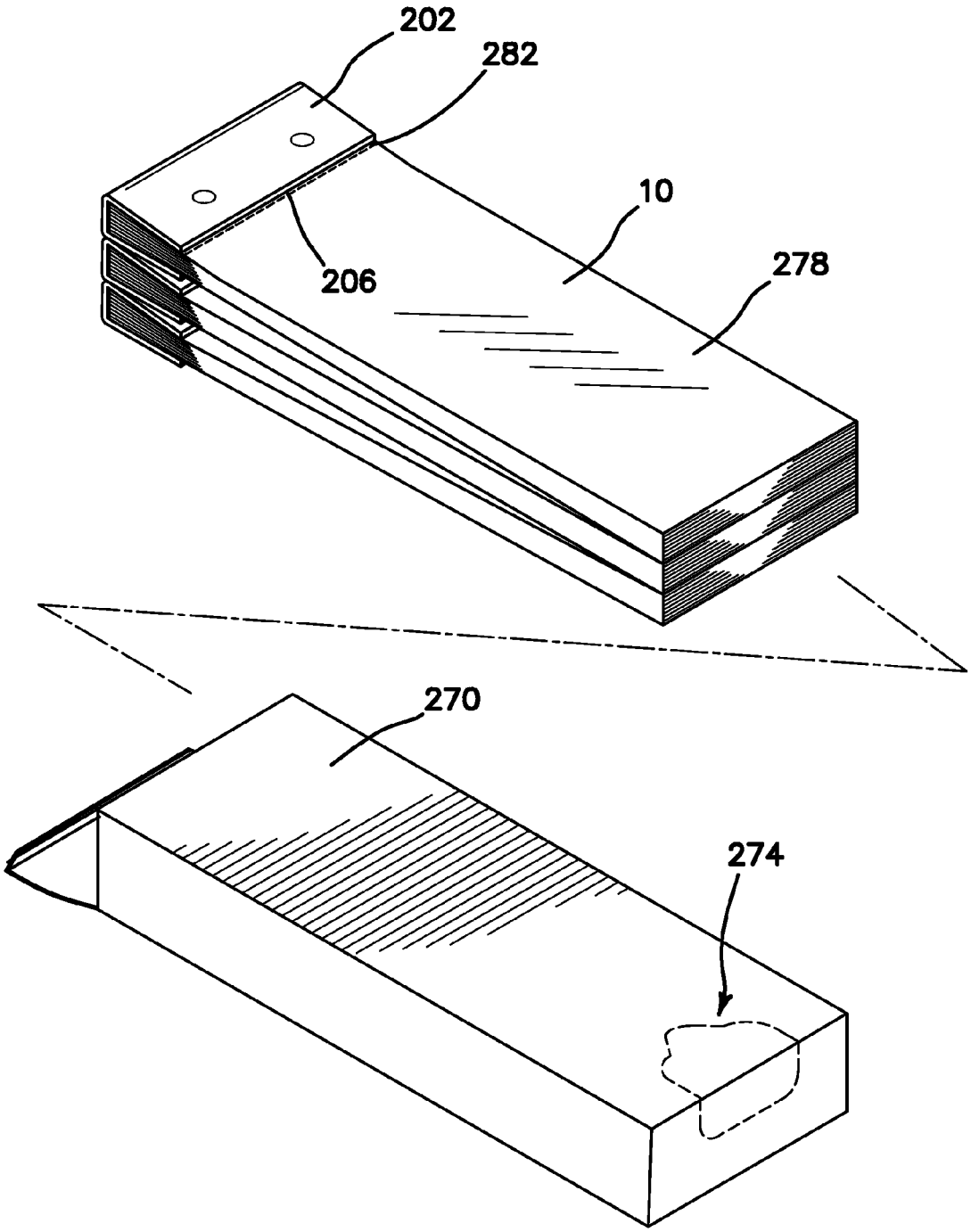
FIG. 12 is a perspective view of multiple stacks of header bags prior to insertion in a dispensing container.

(24) In another variant of the invention, as illustrated in FIG. 12, the bags 10 are removably attached to a header 202.

(25) In still another variant, the bags 10 are removably attached to the header 202 at a perforation line 206.

Figure 15:
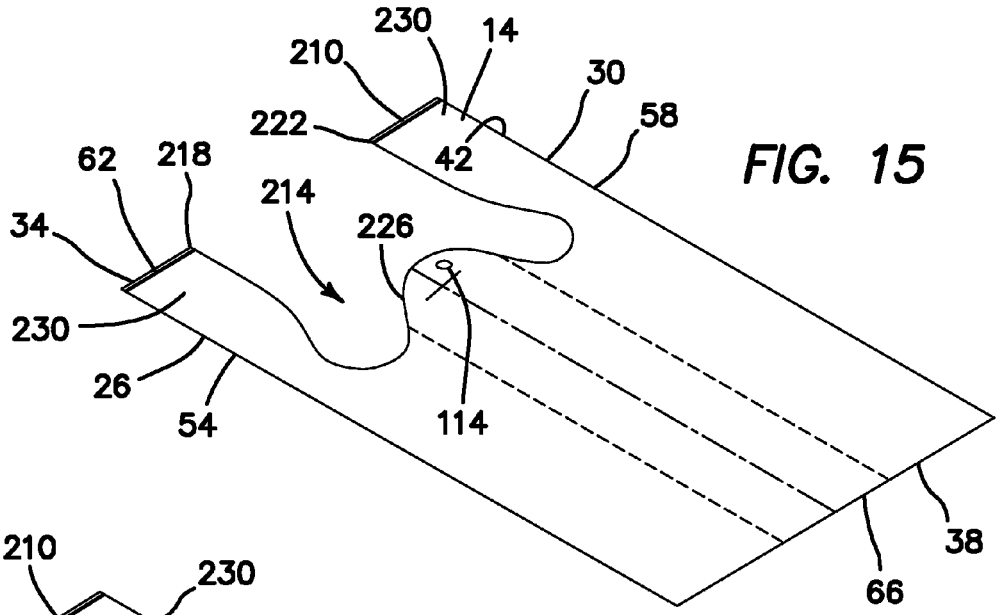
FIG. 15 is a perspective view of a t-shirt style bag with attaching feature that is sealed at the bottom after folding.
Figure 15A:
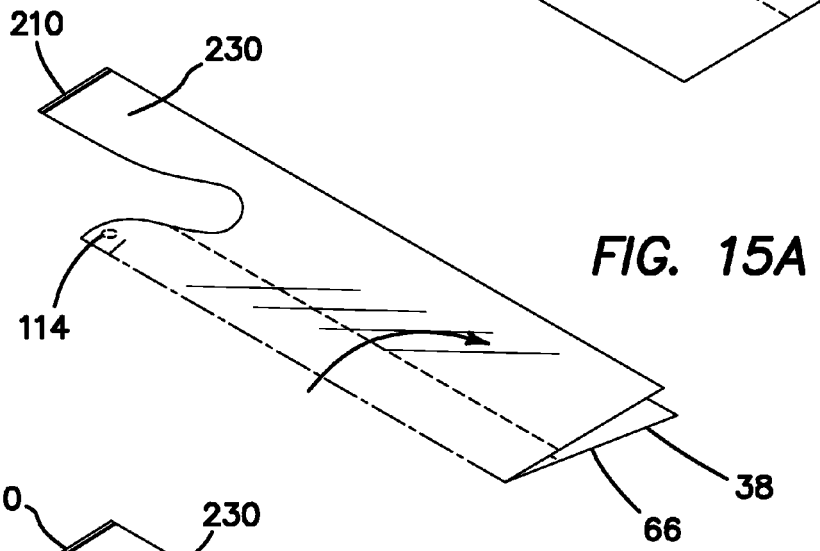
FIG. 15A is a perspective view of the FIG. 15 embodiment partially folded.
Figure 15B:
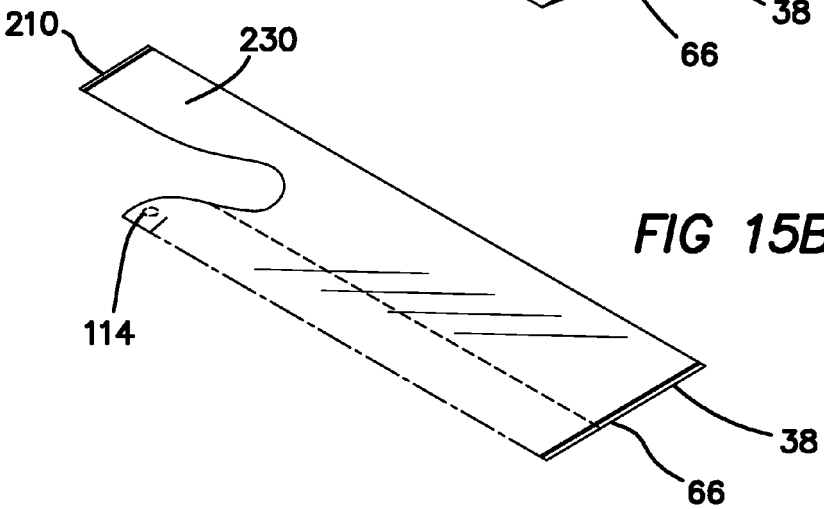
FIG. 15B is a perspective view of the FIG. 15 embodiment after folding.
Figure 16:
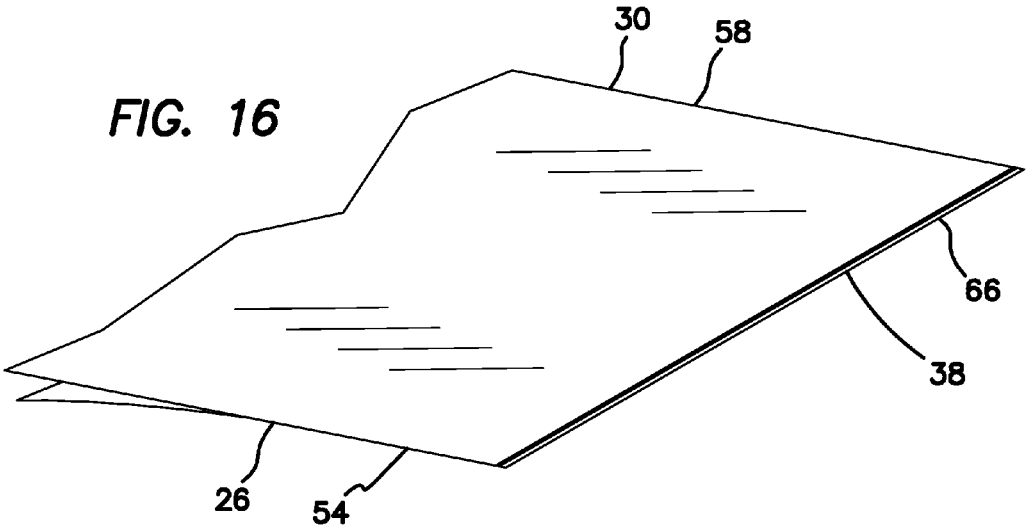
FIG. 16 is a perspective view of a portion of a film tube from which a bottom gusset bag with attaching feature is formed.
Figure 16A:
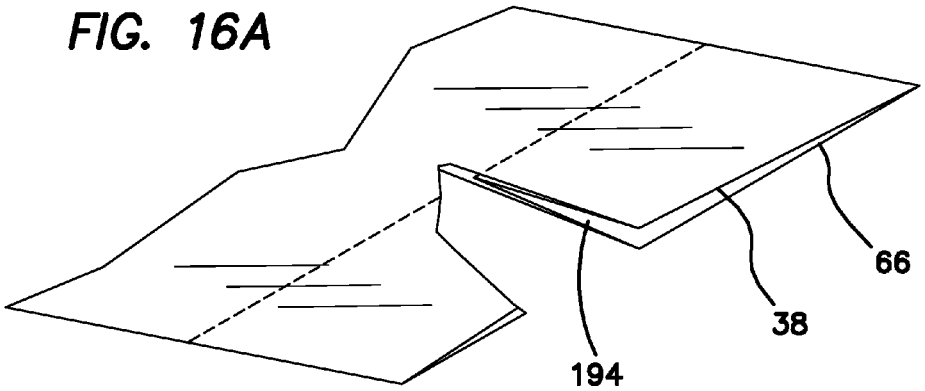
FIG. 16A is a partial perspective view of the FIG. 16 tube after formation of the gusset and sealing of the side edges.
Figure 16B:
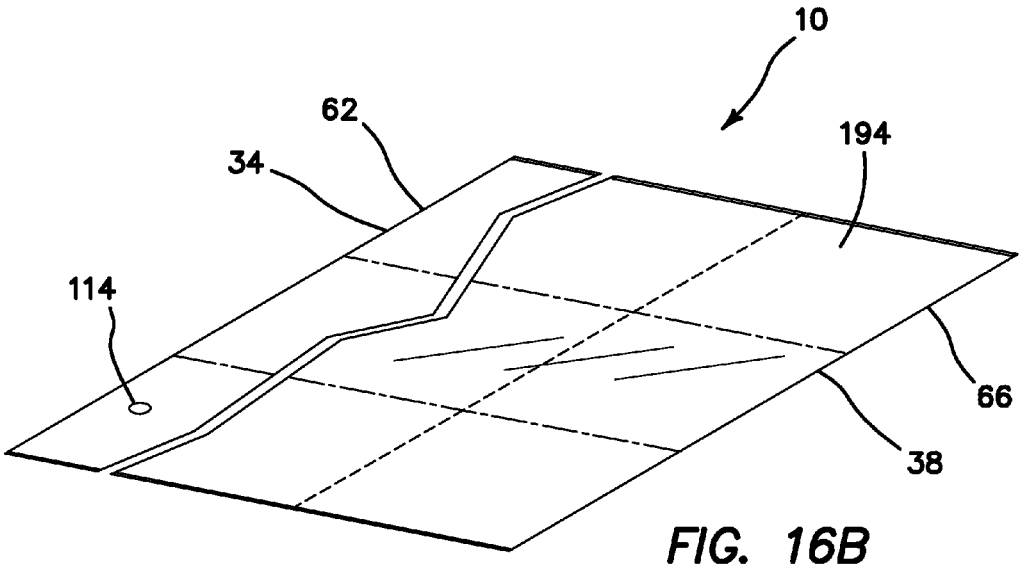
FIG. 16B is a partial perspective view of the FIG. 16 embodiment prior to folding.
Figure 16C:
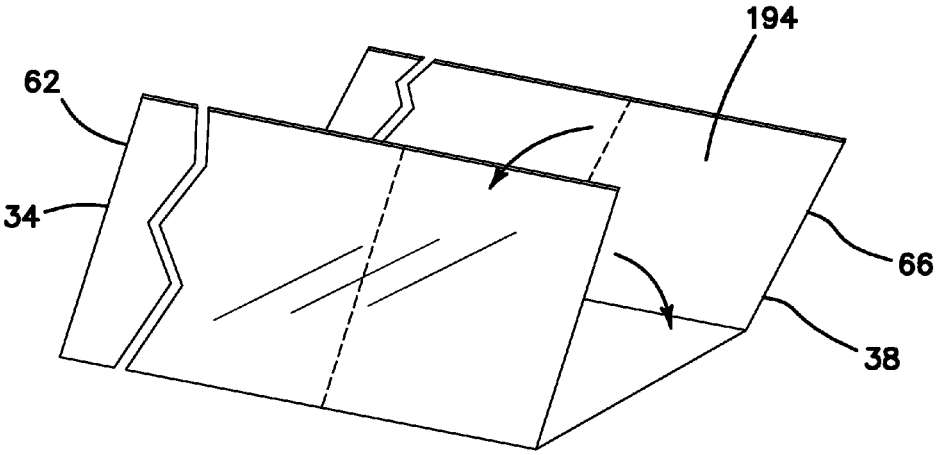
FIG. 16C is a partial perspective view of the FIG. 16 embodiment partially folded.

(26) In yet another variant, as illustrated in FIGS. 15, 15A and 15B, an upper seam 210 is provided. The seam 210 seals the front wall 14 to the rear wall 42 adjacent the top edges 34, 62. A U-shaped cut-out 214 is provided. The cut-out 214 commences at a first point 218 on the top edges 34, 62 spaced inwardly from the first side edges 26, 54, extends downwardly toward the bottom edges 38, 66, extends inwardly toward the second side edges 30, 58 and continues upwardly to a second point 222 on the top edges 34, 62 spaced inwardly from the second side edges 30, 58. The cut-out 214 forms an open bag mouth 226 and a pair of bag handles 230 that terminate at the upper seam 210.

Figure 11:
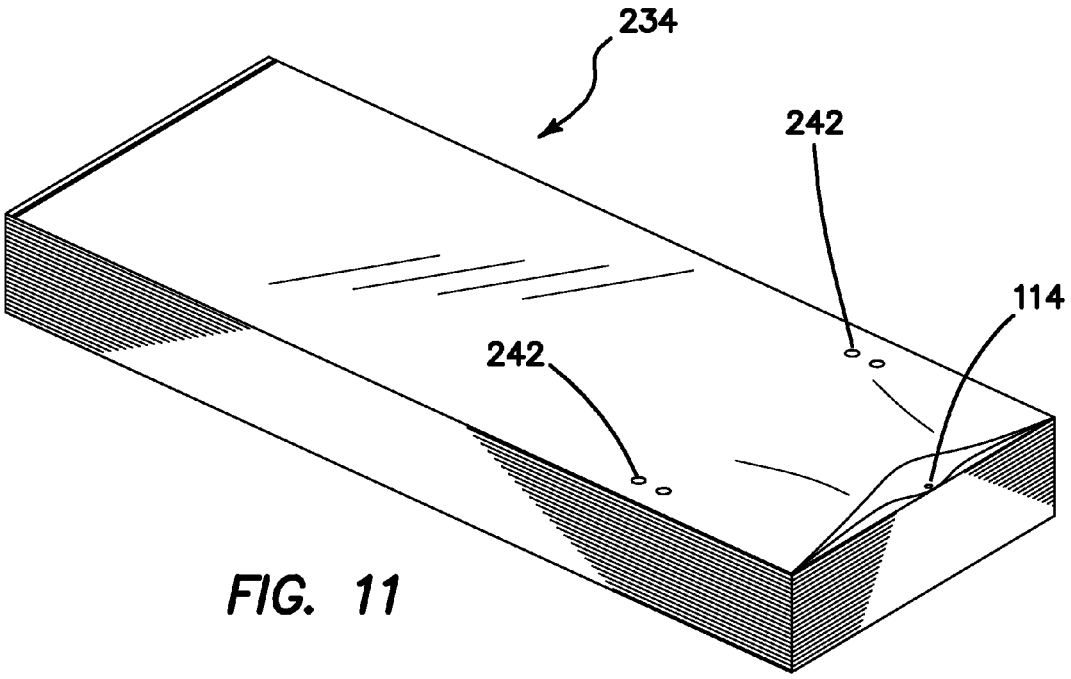
FIG. 11 is a perspective view of a stack of vertically folded bags with an attaching feature adjacent an upper end of the bag.

(27) In a further variant, as illustrated in FIG. 11, the bags 10 are formed into a registered bag stack 234.

(28) In still a further variant, each of the bags 10 is releasably attached to a subsequent bag 10 in the bag stack 234 using a method selected from the group that includes cold staking (not shown), hot pinning 242, multiple corona treatment (not shown), corona treatment with pressure points (not shown), knife cutting (not shown), special resin formulations (not shown), and glue spotting (not shown).

Figure 13:
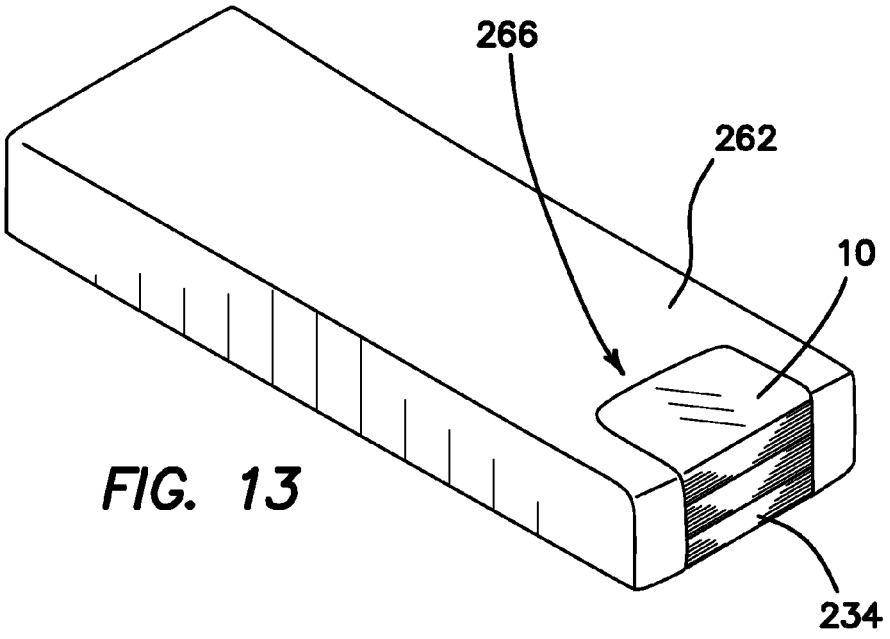
FIG. 13 is a perspective view of multiple stacks of bags enclosed in a flexible outer cover with dispensing aperture.

(29) In yet a further variant, as illustrated in FIG. 13, at least one of the bag stacks 234 is secured within a flexible covering 262. The covering 262 has an aperture 266 for removal of bags 10 from the at least one bag stack 234.

Figure 14:
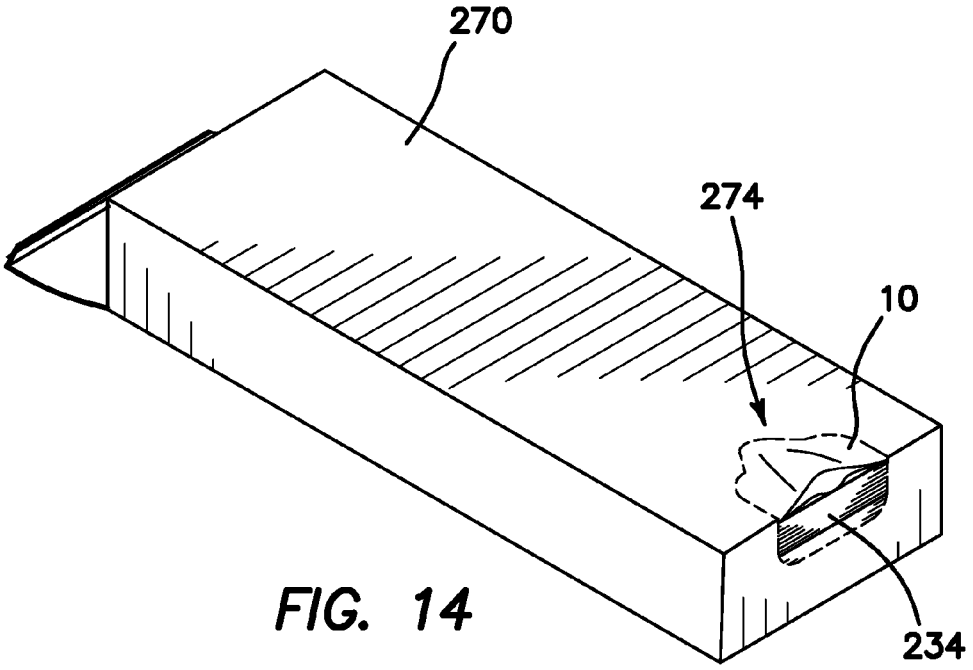
FIG. 14 is a perspective view of multiple stacks of bags in a dispensing container.

(30) In another variant of the invention, as illustrated in FIG. 14, a container 270 is provided. The container 270 is sized and shaped to slidably enclose at least one of the bag stacks 234. The container 234 has an aperture 274 for removal of the bags 10 from the at least one bag stack 234.

(31) In still another variant, as illustrated in FIG. 12, each of the bags 10 has a dispensed portion 278 and a remaining portion 282. The remaining portion 282 is secured within the container 270.

(32) In a final variant, as illustrated in FIGS. 13 and 14, at least one bag stack 234 located within the flexible covering 262 is located within the container 270.

The self opening bags 10, 74, 126, 130, 158, 164, 166 have been described with reference to particular embodiments. Other modifications and enhancements can be made without departing from the spirit and scope of the claims that follow.

The invention claimed is:

1. A self opening bag, comprising:

a front wall, said front wall having an inner surface, an outer surface, first and second side edges, a top edge and a bottom edge;

a rear wall, said rear wall having an inner surface, an outer surface, first and second side edges, a top edge and a bottom edge;

said front wall being joined to said rear wall adjacent respective first and second side edges thereof;

said front wall being sealed to said rear wall adjacent respective bottom edges thereof;

an open mouth disposed adjacent said top edges;

said bag being folded twice parallel to said side edges to form a C-folded bag one third of a width of said bag;

said outer surface of said front wall having first, second and third portions, each of said portions having an upper end adjacent said open mouth;

said outer surface of said rear wall having fourth, fifth and sixth portions, each of said portions having an upper end adjacent said open mouth;

said bag being folded to dispose said third portion immediately adjacent said second portion and said first portion immediately adjacent said sixth portion;

at least one attaching feature, said attaching feature disposed at at least one of a first point between said first portion and said sixth portion adjacent said upper end and a second point between said second portion and said third portion adjacent said upper end;

said attaching feature securing at least one of said first portion to said sixth portion and second portion to said third portion;

said bottom edges of said folded bag being releasably attached to said top edges of a subsequent folded bag;

said folded bags being rolled into a compact bag roll; and said at least one attaching feature causing said bag to open as said bag is pulled from said subsequent bag.

2. A self opening bag, comprising:

a front wall, said front wall having an inner surface, an outer surface, first and second side edges, a top edge and a bottom edge;

a rear wall, said rear wall having an inner surface, an outer surface, first and second side edges, a top edge and a bottom edge;

said front wall being joined to said rear wall adjacent respective first and second side edges thereof;

said front wall being sealed to said rear wall adjacent respective bottom edges thereof;

said bag being folded at least once parallel to said side edges along at least one vertical fold line to form a folded bag having a width less than an unfolded width of said bag;

an open mouth disposed adjacent said top edges;

said outer surface of said front wall being divided into at least two portions along said vertical fold lines, each of said portions having an upper end adjacent said open mouth;

said outer surface of said rear wall being divided into at least two portions along said vertical fold lines, each of said portions having an upper end adjacent said open mouth;

said bag being folded to dispose at least one of said portions immediately adjacent another of said portions;

at least one attaching feature, said attaching feature disposed at a point between at least one adjacent pair of said portions adjacent said upper end;

said attaching feature securing at least one adjacent pair of said portions together;

said bottom edges of said folded bag being releasably attached to said top edges of a subsequent folded bag;

said folded bags being rolled into a compact bag roll; and said at least one attaching feature causing said bag to open as said bag is pulled from said subsequent bag.

3. The self opening bag, as described in claims 1 or 2, wherein said outer surface of at least one of said front wall and said rear wall of said bags is corona treated.

4. The self opening bag, as described in claims 1 or 2, wherein each of said bags is releasably attached to a subsequent bag using an attaching feature selected from the group comprising:

cold staking, hot pinning, multiple corona treatment, corona treatment with pressure points, knife cutting, special resin formulations, and glue spotting.

5. The self opening bag, as described in claims 1 or 2, wherein said attaching feature is any of a natural substance, a synthetic substance and other attaching means not requiring a separate substance.

6. The self opening bag, as described in claims 1 or 2, wherein said attaching feature is any of sprayed, rolled and dropped on said outer bag surfaces.

7. The self opening bag, as described in claims 1 or 2, wherein said attaching feature comprises any of mechanical and electrical manipulation of said bag surfaces.

* * * * *